US009199277B2

(12) United States Patent
Miyazawa

(10) Patent No.: US 9,199,277 B2
(45) Date of Patent: Dec. 1, 2015

(54) ULTRASONIC MEASUREMENT DEVICE, ULTRASONIC HEAD UNIT, ULTRASONIC PROBE, AND ULTRASONIC IMAGE DEVICE

(71) Applicant: SEIKO EPSON CORPORATION, Tokyo (JP)

(72) Inventor: Takao Miyazawa, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 41 days.

(21) Appl. No.: 14/164,579

(22) Filed: Jan. 27, 2014

(65) Prior Publication Data

US 2014/0211592 A1 Jul. 31, 2014

(30) Foreign Application Priority Data

Jan. 29, 2013 (JP) ..... 2013-014033

(51) Int. Cl.
*G10K 11/18* (2006.01)
*B06B 1/06* (2006.01)
*B06B 1/02* (2006.01)

(52) U.S. Cl.
CPC ..... *B06B 1/0629* (2013.01); *B06B 1/0215* (2013.01); *B06B 2201/20* (2013.01); *B06B 2201/55* (2013.01)

(58) Field of Classification Search
CPC B06B 1/0629; B06B 1/0215; B06B 2201/55; B06B 2201/20
USPC ..... 367/140
See application file for complete search history.

(56) References Cited

U.S. PATENT DOCUMENTS

| | | | | |
|---|---|---|---|---|
| 2008/0009741 | A1* | 1/2008 | Hyuga | 600/459 |
| 2008/0021324 | A1* | 1/2008 | Seto | 600/447 |
| 2008/0045838 | A1* | 2/2008 | Hyuga | 367/117 |
| 2009/0251025 | A1* | 10/2009 | Kondou et al. | 310/316.01 |
| 2010/0249598 | A1* | 9/2010 | Smith et al. | 600/459 |
| 2010/0268089 | A1* | 10/2010 | Degertekin | 600/467 |
| 2012/0188849 | A1 | 7/2012 | Matsuda et al. | |
| 2013/0261465 | A1* | 10/2013 | Nakamura et al. | 600/459 |
| 2014/0088431 | A1* | 3/2014 | Miyazawa | 600/459 |
| 2014/0104989 | A1* | 4/2014 | Matsuda | 367/138 |

(Continued)

FOREIGN PATENT DOCUMENTS

| | | | |
|---|---|---|---|
| CN | 103961138 A | * | 8/2014 |
| JP | 08-062196 A | | 3/1996 |

(Continued)

*Primary Examiner* — Daniel Pihulic
(74) *Attorney, Agent, or Firm* — Global IP Counselors, LLP

(57) ABSTRACT

An ultrasonic measurement device includes: an ultrasonic element array that has at least one reception column connected to a reception terminal, and equipped with ultrasonic elements for reception and that has at least one transmission column connected to a transmission terminal, and equipped with ultrasonic elements for transmission; a reception circuit that receives a signal from the reception terminal; and a transmission circuit that outputs a signal to the transmission terminal. The reception column and the transmission column are alternately arranged every column, or any multiple of columns in a scanning direction. The ultrasonic elements for reception and the ultrasonic elements for transmission are arranged along a orthogonal direction that is orthogonal to the scanning direction. The reception terminal is arranged at one end of the array in the orthogonal direction, and the transmission terminal is arranged at the other end of the array in that direction.

12 Claims, 18 Drawing Sheets

(56) References Cited

U.S. PATENT DOCUMENTS

| | | | | |
|---|---|---|---|---|
| 2014/0116139 | A1* | 5/2014 | Endo | 73/584 |
| 2014/0116140 | A1* | 5/2014 | Endo | 73/584 |
| 2014/0116147 | A1* | 5/2014 | Endo | 73/658 |
| 2014/0116148 | A1* | 5/2014 | Endo | 73/661 |
| 2014/0211592 | A1* | 7/2014 | Miyazawa | 367/135 |
| 2014/0241112 | A1* | 8/2014 | Kano | 367/7 |
| 2014/0267504 | A1* | 9/2014 | Ohashi et al. | 347/68 |
| 2014/0292941 | A1* | 10/2014 | Kobayashi et al. | 347/68 |
| 2015/0027228 | A1* | 1/2015 | Endo | 73/641 |
| 2015/0029818 | A1* | 1/2015 | Endo | 367/138 |

FOREIGN PATENT DOCUMENTS

| | | | |
|---|---|---|---|
| JP | 2002-034982 | A | 2/2002 |
| JP | 2003-000599 | A | 1/2003 |
| JP | 2003-325507 | A | 11/2003 |
| JP | 2004-057460 | A | 2/2004 |
| JP | 2005-040376 | A | 2/2005 |
| JP | 2012-152319 | A | 8/2012 |
| JP | 2013-013570 | A | 1/2013 |
| JP | 2014-064629 | A | 4/2014 |

* cited by examiner

ULTRASONIC MEASUREMENT DEVICE, ULTRASONIC HEAD UNIT, ULTRASONIC PROBE, AND ULTRASONIC IMAGE DEVICE

BACKGROUND

1. Technical Field

The present invention relates to ultrasonic measurement devices, ultrasonic head units, ultrasonic probes, ultrasonic image devices, etc.

2. Related Art

As a device for irradiating an object with ultrasonic waves and receiving reflected waves from the interfaces inside the object that have different acoustic impedances, ultrasonic image devices for inspecting the inside of a human body, etc. have been known, for example. With regard to the ultrasonic image devices, a technique to use a continuous-wave mode etc. has been known. In the technique, ultrasonic elements are divided into the elements only for transmission and the elements only for reception.

For example, JP-A-2004-057460 discloses a technique in which transmission ultrasonic element columns and reception ultrasonic element columns are alternately arranged in the slice direction that is orthogonal to the scanning direction. In the transmission/reception ultrasonic element columns, ultrasonic elements are arranged along the scanning direction.

SUMMARY

An advantage of some aspects of the invention is to provide an ultrasonic measurement device, an ultrasonic head unit, an ultrasonic probe, an ultrasonic image device, etc., in which one or more transmission ultrasonic element columns and one or more reception ultrasonic element columns can be alternately arranged in the scanning direction.

One aspect of the invention relates to an ultrasonic measurement device. The ultrasonic measurement device includes: an ultrasonic element array that has at least one reception ultrasonic element column equipped with ultrasonic elements for reception and that has at least one transmission ultrasonic element column equipped with ultrasonic elements for transmission; a reception terminal connected to the reception ultrasonic element column; a transmission terminal connected to the transmission ultrasonic element column; a reception circuit that receives a reception signal from the reception terminal; and a transmission circuit that outputs a transmission signal to the transmission terminal. The at least one reception ultrasonic element column and the at least one transmission ultrasonic element column are alternately arranged every column, or any multiple of columns in a first direction, the first direction being a scanning direction. The ultrasonic elements in the reception ultrasonic element column are arranged along a second direction that is orthogonal to the first direction. The ultrasonic elements in the transmission ultrasonic element column are arranged along the second direction. The reception terminal is arranged at one end of the ultrasonic element array in the second direction. The transmission terminal is arranged at the other end of the ultrasonic element array in the second direction. In this specification, the ultrasonic element for reception in the reception ultrasonic element column may be referred to as "reception ultrasonic element" and the ultrasonic element for transmission in the transmission ultrasonic element column may be referred to as "transmission ultrasonic element."

According to one aspect of the invention, the at least one reception ultrasonic element column and the at least one transmission ultrasonic element column are alternately arranged every column, or any multiple of columns in a first direction, the first direction being the scanning direction, the reception terminal connected to the reception ultrasonic element column is arranged at one end of the ultrasonic element array in the second direction that crosses the first direction, the transmission terminal connected to the transmission ultrasonic element column is arranged at the other end of the ultrasonic element array in the second direction. In this case, one or more transmission ultrasonic element columns and one or more reception ultrasonic element columns can be alternately arranged in the scanning direction.

According to one aspect of the invention, the device may include: a first bias setting circuit that is provided between the reception circuit and the reception terminal and that sets a node of the reception terminal to a first bias voltage; and a second bias setting circuit that is provided between the transmission circuit and the transmission terminal and that sets a node of the transmission terminal to a second bias voltage.

According to one aspect of the invention, the first bias setting circuit and the second bias setting circuit may independently set the first bias voltage and the second bias voltage.

In this aspect of the invention, the bias voltage of the transmission ultrasonic element column and that of the reception ultrasonic element column can be set independently, and thus the characteristic of the transmission ultrasonic element column and the characteristic of the reception ultrasonic element column can be optimized independently.

According to one aspect of the invention, the first bias setting circuit may have a setting circuit that sets the node of the reception terminal to a fixed potential during an ultrasonic wave transmission period.

In this aspect, a reception electrode line connected to the reception ultrasonic element column can be connected to a fixed potential during the transmission period. Because of this, the reception electrode line at the fixed potential is inserted between the transmission electrode lines connected to the transmission ultrasonic element column, and thus any cross talk between the transmission electrode lines can be suppressed.

According to one aspect of the invention, the first bias setting circuit may have a resistive element provided between a node of a supply line of the first bias voltage and the node of the reception terminal, and the setting circuit may have a switching element provided between a node of a supply line of the fixed potential and the node of the reception terminal, the switching element being turned ON during the ultrasonic wave transmission period.

In this aspect, the first bias voltage can be set to a reception terminal through the resistive element, and the fixed potential can be set to the reception terminal through the switching element during the ultrasonic wave transmission period.

According to one aspect of the invention, the device may include a first flexible substrate on which a first integrated circuit device having the reception circuit is mounted; and a second flexible substrate on which a second integrated circuit device having the transmission circuit is mounted.

This aspect allows the reception circuit and the transmission circuit to be provided on the flexible substrates, and thus an ultrasonic probe can be miniaturized compared with the case in which the reception circuit and the transmission circuit are provided on, for example, a rigid substrate of a probe body. Furthermore, since the reception terminal and the transmission terminal can be provided respectively at the one and the other ends of an ultrasonic transducer device, the first flexible substrate provided with the reception circuit and the second flexible substrate provided with the transmission circuit can be separated.

According to one aspect of the invention, a reception signal line connected to the reception terminal may be formed on the first flexible substrate, the first integrated circuit device may be mounted on the first flexible substrate so that a long side direction of the first integrated circuit device runs along a direction that crosses a direction of the reception signal line, a transmission signal line connected to the transmission terminal may be formed on the second flexible substrate, and the second integrated circuit device may be mounted on the second flexible substrate so that a long side direction of the second integrated circuit device runs along a direction that crosses a direction of the transmission signal line.

In this aspect, the end of the ultrasonic element array (the end on which the reception terminal is provided) and the long side of the first integrated circuit device can face each other, and the end of the ultrasonic element array (the end on which the transmission terminal is provided) and the long side of the second integrated circuit device can face each other. This allows wiring of the reception signal line and the transmission signal line to be simple, and allows the ultrasonic measurement device to be compact.

According to one aspect of the invention, the reception circuit may be one of a plurality of reception circuits included in the first integrated circuit device, the plurality of reception circuits may be arranged along the long side direction of the first integrated circuit device in a state in which the first integrated circuit device is mounted on the first flexible substrate, the transmission circuit may be one of a plurality of transmission circuits included in the second integrated circuit device, and the plurality of transmission circuits may be arranged along the long side direction of the second integrated circuit device in a state in which the second integrated circuit device is mounted on the second flexible substrate.

In this aspect, the first integrated circuit device and the second integrated circuit device can be formed in a rectangular shape that is elongated along the long side direction. Furthermore, the end of the ultrasonic element array (the end on which the reception terminal is provided) and the plurality of reception circuits arranged along the long side direction of the first integrated circuit device can face each other, and the end of the ultrasonic element array (the end on which the transmission terminal is provided) and the plurality of transmission circuits arranged along the long side direction of the second integrated circuit device can face each other.

According to one aspect of the invention, the first integrated circuit device may be flip-chip mounted on the first flexible substrate, and the second integrated circuit device may be flip-chip mounted on the second flexible substrate.

This allows the mounting area to be reduced compared with the mounting using flat package etc., and allows the ultrasonic measurement device to be further miniaturized.

According to one aspect of the invention, the device may include a substrate on which the ultrasonic element array, the reception terminal, and the transmission terminal are arranged, wherein the ultrasonic element array may have a plurality of ultrasonic elements as the reception ultrasonic element column and the transmission ultrasonic element column, the substrate may have a plurality of openings arranged in an array pattern, each of the plurality of ultrasonic elements may have a vibrating film covering a corresponding opening among the plurality of openings and has a piezoelectric element part provided on the vibrating film, and the piezoelectric element part may have a lower electrode provided on the vibrating film, a piezoelectric membrane provided so as to cover at least part of the lower electrode, and an upper electrode provided so as to cover at least part of the piezoelectric membrane.

In this aspect, the ultrasonic element array can be constituted with ultrasonic elements in which the piezoelectric element vibrates the vibrating film that covers the opening. This allows the ultrasonic element to be driven with a drive signal at a low voltage compared with the case using a bulk-type piezoelectric element. Because of this, the integrated circuit device can be produced by a process for a low breakdown voltage, which allows the integrated circuit device to be made compact.

Another aspect of the invention relates to an ultrasonic head unit including any one of the above-mentioned ultrasonic measurement devices, the ultrasonic head unit being detachable from a probe body of an ultrasonic probe.

Still another aspect of the invention relates to an ultrasonic probe including any one of the above-mentioned ultrasonic measurement devices.

Yet another aspect of the invention relates to an ultrasonic image device including any one of the above-mentioned ultrasonic measurement devices and a display section that displays display image data.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, preferred embodiments of the invention will be described in detail. The embodiments described below do not unreasonably limit the subject matter of the invention defined in the claims, and all the elements described in the embodiments are not necessarily essential as the means for achieving the object of the invention.

1. Ultrasonic Element

The bulk type ultrasonic elements have difficulty in narrowing the element pitch, and thus they have a problem in that the transmission ultrasonic element columns and the reception ultrasonic element columns cannot be alternately arranged in the scanning direction. For example, the pitch, in the scanning direction, of the transmission (or reception) ultrasonic element columns is large, and thus a grating lobe (side lobe) occurs. Hereinafter, an ultrasonic measurement device of the present embodiment, which can solve such a problem, is described.

Figure 1A:
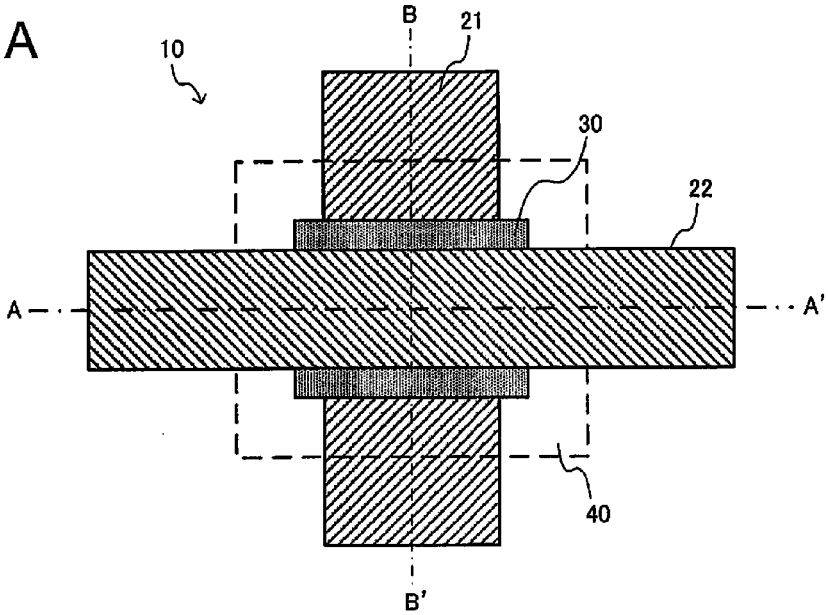
FIG. 1A to FIG. 1C show a configuration example of an ultrasonic element.
Figure 1B:
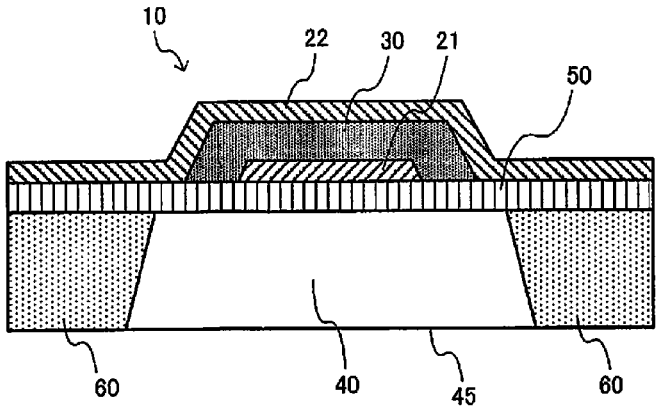
Figure 1C:
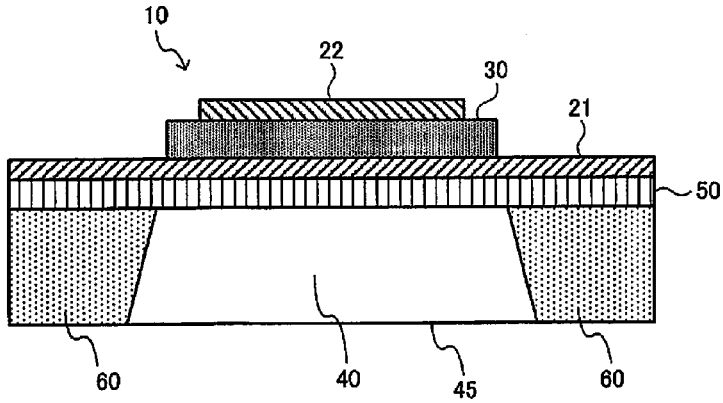

FIG. 1A-FIG. 1C show a configuration example of an ultrasonic element 10, which is used in the ultrasonic measurement device of the present embodiment. The ultrasonic element 10 has a vibrating film (membrane, support member) 50 and a piezoelectric element part. The piezoelectric element part has a lower electrode (first electrode layer) 21, a piezoelectric layer (piezoelectric membrane) 30, and an upper electrode (second electrode layer) 22.

FIG. 1A is a plan view of the ultrasonic element (ultrasonic transducer element) 10 formed on the substrate (silicon substrate) 60, viewed from a direction that is on an element forming surface side and that is perpendicular to the substrate. FIG. 1B is a sectional view along line A-A' in FIG. 1A. FIG. 1C is a sectional view along line B-B' in FIG. 1A.

The first electrode layer 21 is formed on the vibrating film 50 as a metal thin film, for example. The first electrode layer 21 may be a wiring that is extended outside the region in which the element is formed as shown in FIG. 1A, and that is connected to the adjacent ultrasonic element 10.

The piezoelectric layer 30 is formed, for example, of a PZT (lead zirconate titanate) thin film, and is provided so as to cover at least part of the first electrode layer 21. The material of the piezoelectric layer 30 is not limited to PZT, and may be lead titanate ($PbTiO_3$), lead zirconate ($PbZrO_2$), lead lanthanum titanate (Pb, La) ($TiO_3$), etc., for example.

The second electrode layer 22 is, for example, a metal thin film, and is provided so as to cover at least part of the piezoelectric layer 30. The second electrode layer 22 may be a wiring that is extended outside the region in which the element is formed as shown in FIG. 1A, and that is connected to the adjacent ultrasonic element 10.

The vibrating film (membrane) 50 has, for example, a two-layer structure of a $SiO_2$ thin film and a $ZrO_2$ thin film, and is provided so as to cover an opening 40. The vibrating film 50 supports the piezoelectric layer 30 and the first and second electrode layer 21 and 22. The vibrating film 50 vibrates according to the expansion and contraction of the piezoelectric layer 30, thereby generating ultrasonic waves.

The opening (cavity region) 40 is formed by etching (reactive ion etching (RIE) etc.) the silicon substrate 60 from the back side (the side in which the element is not formed) thereof. The resonant frequency of the ultrasonic waves is determined by the size of an opening part 45 of the cavity region 40. The ultrasonic waves are emitted to the piezoelectric layer 30 side (the direction from the back side to the front side in FIG. 1A).

The lower electrode of the ultrasonic element 10 is formed of the first electrode layer 21. The upper electrode is formed of the second electrode layer 22. Specifically, a portion of the first electrode layer 21 (a portion that is covered with the piezoelectric layer 30) forms the lower electrode, and a portion of the second electrode layer 22 (a portion that covers the piezoelectric layer 30) forms the upper electrode. That is, the piezoelectric layer 30 is provided between the lower electrode and the upper electrode.

The piezoelectric layer 30 expands or contracts in the in-plane direction when a voltage is applied between the lower electrode and the upper electrode (i.e., between the first electrode layer 21 and the second electrode layer 22). The ultrasonic element 10 has a monomorphic (unimorph) structure in which a thin piezoelectric element (the piezoelectric layer 30) and a metal plate (the vibrating film 50) are stacked. In this structure, the size of the vibrating film 50 does not change, and thus warpage occurs when the piezoelectric layer 30 expands and contracts in the in-plane direction. The vibrating film 50 vibrates in the thickness direction when an alternating voltage is applied to the piezoelectric layer 30, and the vibration of the vibrating film 50 causes the emission of ultrasonic waves. The voltage applied to the piezoelectric layer 30 is, for example, 10-30 V; and its frequency is, for example, 1-10 MHz.

When the ultrasonic element is configured as mentioned above, the element can be miniaturized compared with a bulk type ultrasonic element, and thus the element pitch can be narrowed. In this case, even when the transmission ultrasonic element columns and the reception ultrasonic element columns are alternately arranged every column, or any multiple of columns, the pitch of the ultrasonic element columns can be narrowed sufficiently, and thus the grating lobe can be suppressed.

2. Ultrasonic Transducer Device

2.1. First Configuration Example

Figure 2:
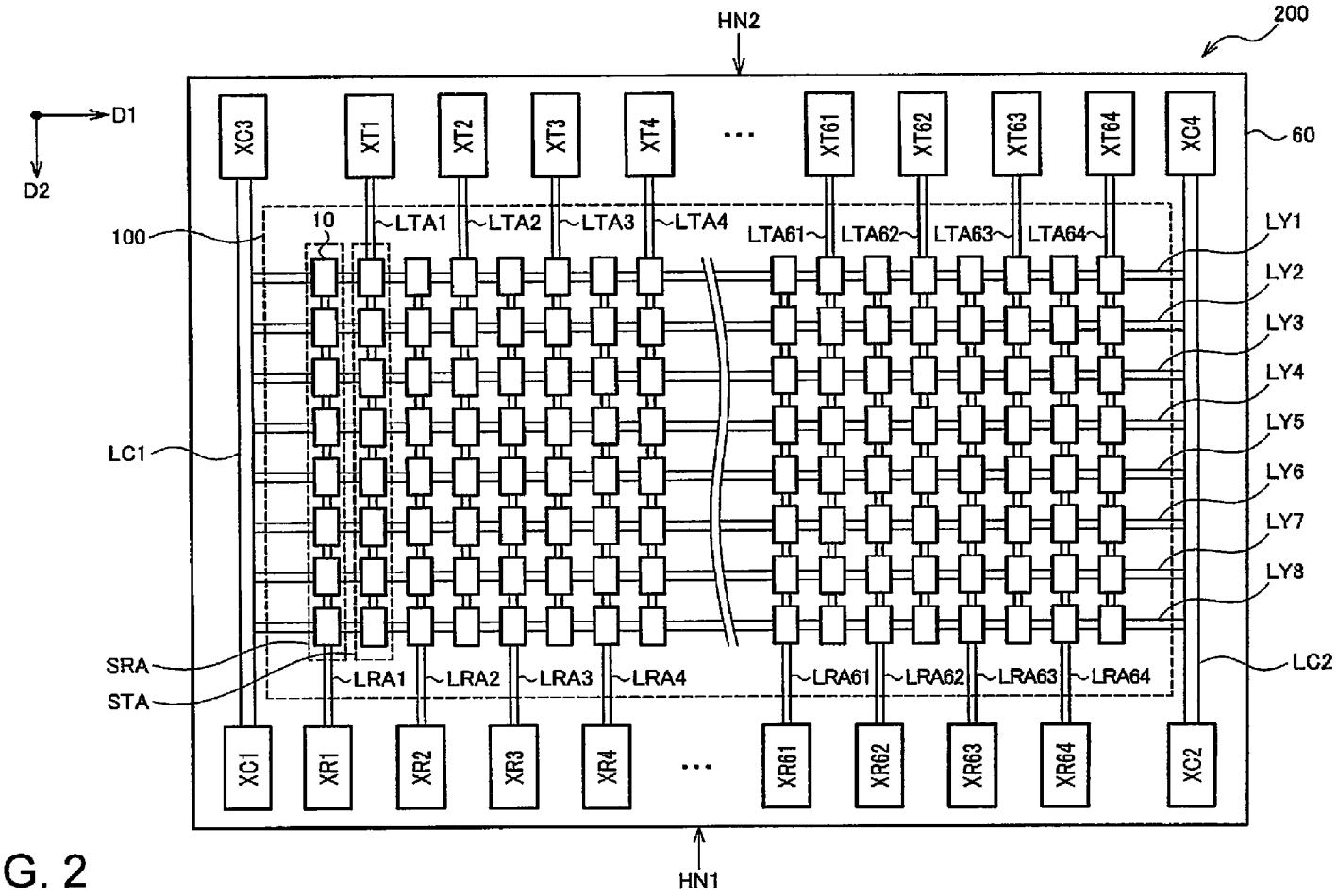
FIG. 2 shows the first configuration example of an ultrasonic transducer device.

FIG. 2 shows the first configuration example of an ultrasonic transducer device 200 included in the ultrasonic measurement device of the present embodiment. The ultrasonic transducer device 200 includes: a substrate 60; an ultrasonic element array 100 formed on the substrate 60; the 1st to the n-th reception terminals XR1-XRn, formed on the substrate 60; the 1st to the n-th transmission terminals XT1-XTn (a plurality of transmission terminals) formed on the substrate 60; the 1st to the 4th common terminals XC1-XC4 formed on the substrate 60; and common electrode lines LC1 and LC2 formed on the substrate 60.

As the ultrasonic transducer device 200, transducers using the above-mentioned piezoelectric element (a thin film piezoelectric element) can be used; however, the present embodiment is not limited to them. For example, transducers using a capacitive element such as c-MUT (Capacitive Micro-machined Ultrasonic Transducers) can be used.

The ultrasonic element array 100 includes: the 1st to the 64th groups of the reception ultrasonic elements, each group being configured of an ultrasonic element column SRA; the 1st to the 64th groups of the transmission ultrasonic elements, each group being configured of an ultrasonic element column STA; the 1st to the n-th reception electrode lines LRA1-LRAn; the 1st to the n-th transmission electrode lines LTA1-LTAn; and the 1st to the m-th common electrode lines LY1-LYm. An example in which m=8 and n=64 is explained below; however, the present embodiment may not be limited to the following example, and "m" and "n" may be other values.

In the reception ultrasonic element column SRA, eight ultrasonic elements 10 (m=8) are arranged along the slice direction D2 (the second direction) that is orthogonal to the scanning direction D1 (the first direction). In the transmission ultrasonic element column STA, eight ultrasonic elements 10 (m=8) are arranged along the slice direction D2. The reception ultrasonic element columns SRA and the transmission ultrasonic element columns STA are alternately arranged every column in the scanning direction D1. That is, the ultrasonic element array 100 is a matrix array of m=8 rows and n=64 columns.

The 1st to the 64th reception terminals XR1-XR64 are arranged at one end of the ultrasonic element array 100 in the slice direction D2. The 1st to the 64th transmission terminals XT1-XT64 are arranged at the other end of the ultrasonic element array 100 in the slice direction D2. For example, the substrate 60 of the ultrasonic transducer device has a rectangular shape whose long side direction runs along the scanning direction D1; the 1st to the 64th reception terminals XR1-XR64 are arranged along the first long side HN1 of the rectangular shape; and the 1st to the 64th transmission terminals XT1-XT64 are arranged along the second long side HN2 of the rectangular shape.

The 1st to the 64th reception electrode lines LRA1-LRA64 are formed along the slice direction D2, and connect the 1st to the 64th groups of the reception ultrasonic elements and the 1st to the 64th reception terminals XR1-XR64, respectively. For example, the first reception electrode line LRA1 connects the first reception terminal XR1 and the ultrasonic element column SRA that configures the reception ultrasonic elements in the first group. The 1st to the 64th transmission electrode lines LTA1-LTA64 are formed along the slice direction D2, and connect the 1st to the 64th groups of the transmission ultrasonic elements and the 1st to the 64th transmission terminals XT1-XT64, respectively. For example, the first transmission electrode line LTA1 connects the first transmission terminal XT1 and the ultrasonic element column STA that configures the transmission ultrasonic elements in the first group.

The 1st to the 8th common electrode lines LY1-LY8 are formed along the scanning direction D1, and supply a common voltage to the reception ultrasonic elements and the transmission ultrasonic elements. The 1st to the 8th common electrode lines LY1-LY8 are connected to the common electrode lines LC1 and LC2 formed along the slice direction D2. One of the ends of the common electrode lines LC1 and one of the ends of the common electrode line LC2 are connected to the common terminals XC1 and XC2, and the other ends are connected to the common terminal XC3 and XC4. The common terminals XC1 and XC2 are arranged at one end of the ultrasonic element array 100 in the slice direction D2, and the common terminals XC3 and XC4 are arranged at the other end of the ultrasonic element array 100.

The above-mentioned electrode lines LRA1-LRA64 and LTA1-LTA64 are formed by a method in which one of the first electrode layer 21 and the second electrode layer 22, which are shown in FIG. 1A to FIG. 1C, is formed on the substrate 60 so as to extend to the terminals XRA1-XR64, XT1-XT64. Furthermore, the common electrode lines LY1-LY8 are formed by a method in which the other one of the first electrode layer 21 and the second electrode layer 22 is formed on the substrate 60 so as to extend to the common electrode lines LC1, LC2. Here, the phrase "formed on the substrate 60 so as to extend to" means a state in which a conductive layer (wiring layer) is deposited on a substrate by, for example, a MEMS process, semiconductor process, etc. and the conductive layer connects at least two points (for example, from the ultrasonic element to the signal terminal).

According to the first configuration example, the ultrasonic element array 100 can be configured with the ultrasonic element using a thin film piezoelectric element, and thus the element pitch can be narrowed compared with the case using a bulk type one. Consequently, the reception ultrasonic element columns and the transmission ultrasonic element columns can be alternately arranged in the scanning direction D1 while suppressing the grating lobe due to the increase of the element pitch. The reception ultrasonic element column is disposed between the transmission ultrasonic element columns, and thus any cross talk between transmission channels can be suppressed.

Furthermore, the reception terminals XR1-XR64 and the transmission terminals XT1-XT64 are arranged along the long sides HN1 and HN2 of the substrate 60, respectively, and thus the reception system (and wirings to the reception terminals XR1-XR64) and the transmission system (and wirings to the transmission terminals XT1-XT64) can be separately arranged. Because of this, the signal coupling between the transmission system with large signal amplitude and the reception system treating weak signals can be minimized.

In the above, an example in which the ultrasonic element array 100 has a matrix arrangement of "m" rows and "n" columns is described. However, the present embodiment is not limited to the example, and can adopt any array arrangement in which a plurality of unit elements (ultrasonic elements) are arranged with regularity in two dimensions. For example, the ultrasonic element array 100 may be arranged in a zigzag pattern. The matrix arrangement is a grid-pattern arrangement of "m" rows and "n" columns, which includes a case where the grid is deformed to be a parallelogram as well as a case where the grid is a rectangle. The arrangement of the zigzag pattern is an arrangement in which a column of "m" ultrasonic elements and a column of "m−1" ultrasonic elements are alternately arranged, and the ultrasonic elements of the column of the "m" ultrasonic elements are arranged in odd number rows among (2m−1) rows, and the ultrasonic elements of the column of the "m−1" ultrasonic elements are arranged in even number rows among (2m31 1) rows.

2.2. Second Configuration Example

In the first configuration example mentioned above, an example in which one ultrasonic element column is connected to one channel that receives or transmits the same signal is described. However, the present embodiment is not limited to the example, and one or more ultrasonic element columns may be connected to one channel.

Figure 3:
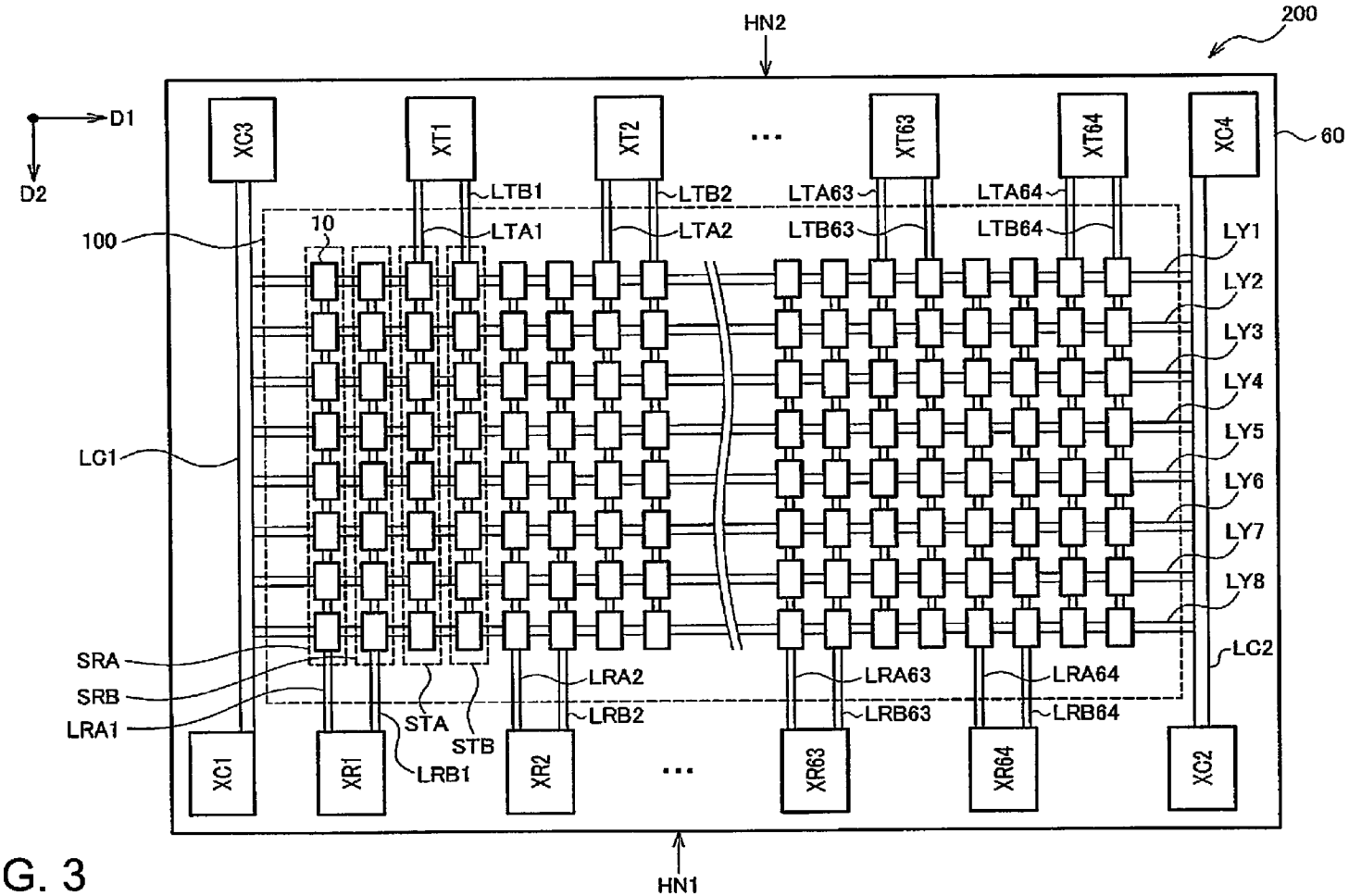
FIG. 3 shows the second configuration example of an ultrasonic transducer device.

As a configuration example in such a case, FIG. 3 shows the second configuration example of the ultrasonic transducer device 200. The ultrasonic transducer device 200 includes: the substrate 60; the ultrasonic element array 100; the 1st to the 64th reception terminals XR1-XR64; the 1st to the 64th transmission terminals XT1-XT64; the 1st to the 4th common terminals XC1-XC4; and the common electrode lines LC1, LC2. In the following description, the same components as those in the first configuration example are designated by the same reference numerals and symbols, and overlapping description thereof may be omitted.

The ultrasonic element array 100 includes: the 1st to the 64th groups of the reception ultrasonic elements; the 1st to the 64th groups of the transmission ultrasonic elements; the 1st to the 64th pairs of reception electrode lines LRA1-LRA64, LRB1-LRB64; the 1st to the 64th pairs of transmission electrode lines LTA1-LTA64, LTB1-LTB64; and the 1st to the 8th common electrode lines LY1-LY8.

Each of the 1st to the 64th groups of the reception ultrasonic elements is composed of two columns, i.e., the ultrasonic element columns SRA and SRB. Each of the 1st to the 64th groups of the transmission ultrasonic elements is composed of two columns, i.e., the ultrasonic element columns STA and STB. That is, along the scanning direction D1, the reception ultrasonic element columns SRA, SRB and the transmission ultrasonic element columns STA, STB are alternately arranged every two columns. In the ultrasonic element columns SRA and SRB, eight ultrasonic elements 10 (m=8) are arranged along the slice direction D2, as in the case of ultrasonic element columns SRA and STA.

The reception ultrasonic element columns SRA and SRB are connected to two reception signal lines in one-to-one correspondence. The two reception signal lines constituting a single pair are connected to the same reception terminal. For example, two reception electrode lines LRA1 and LRB1 are connected to the first reception terminal XR1 as a single pair of the reception signal lines, and are connected to the ultrasonic element columns SRA and SRB, respectively. The transmission ultrasonic element columns STA and STB are connected to two corresponding transmission signal lines in one-to-one correspondence. The two transmission signal lines constituting a single pair are connected to the same transmission terminal. For example, two transmission electrode lines LTA1 and LTB1 are connected to the first transmission terminal XT1 as a single pair of the transmission signal lines, and are connected to the ultrasonic element columns STA and STB, respectively.

In the second configuration example, two ultrasonic element columns are connected to each channel, and thus the improvement in performance of ultrasonic measurement is expected. For example, the power of a transmission beam can be increased since the number of the ultrasonic elements connected to each transmission channel increases.

2.3. Third Configuration Example

Figure 4:
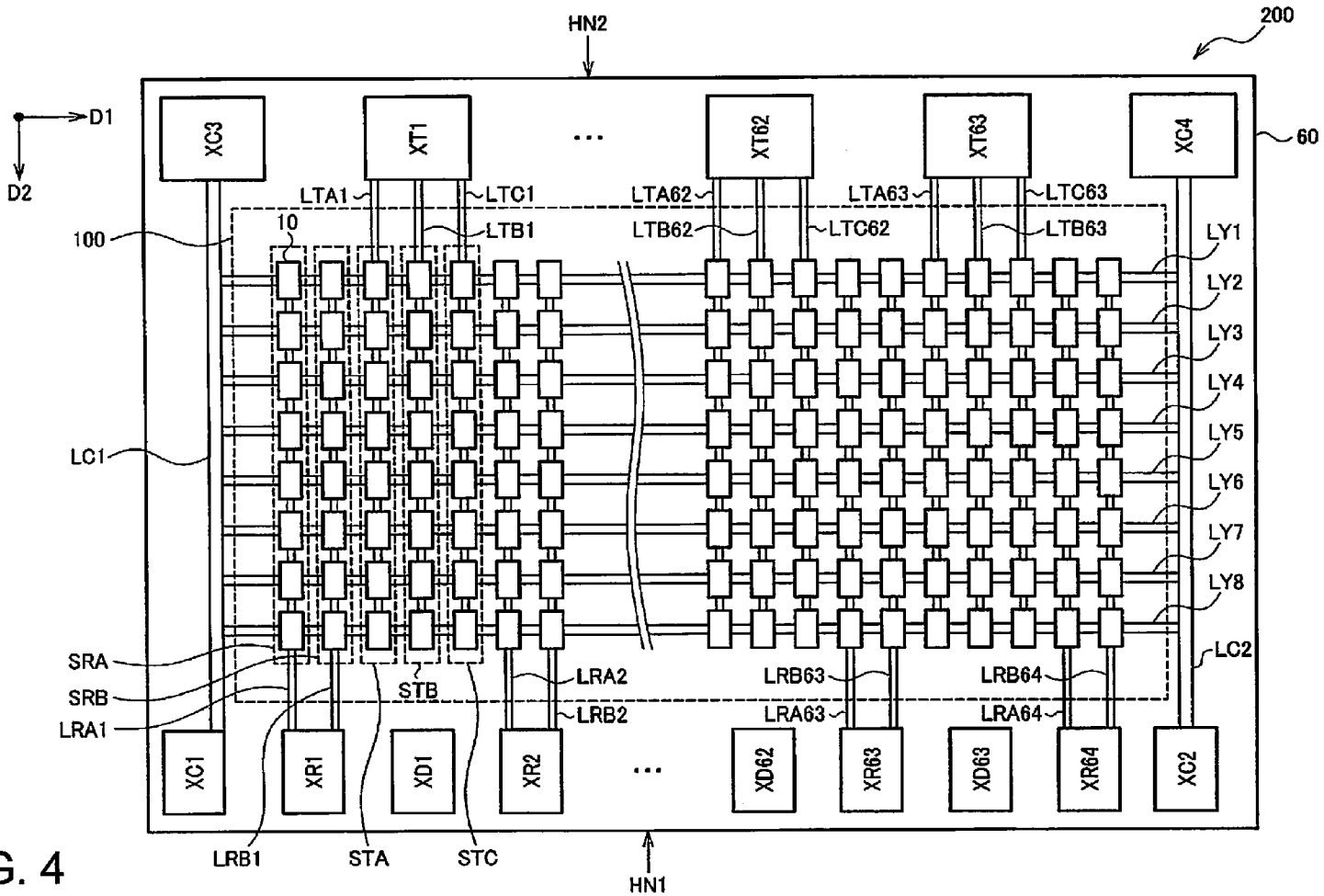
FIG. 4 shows the third configuration example of an ultrasonic transducer device.

FIG. 4 shows the third configuration example of the ultrasonic transducer device 200. The ultrasonic transducer device 200 includes: the substrate 60; the ultrasonic element array 100; the 1st to the 64th reception terminals XR1-XR64; the 1st to the 63th transmission terminals XT1-XT63; the 1st to the 4th common terminals XC1-XC4; and the common electrode lines LC1, LC2. In the following description, the same components as those in the first and second configuration examples are designated by the same reference numerals and symbols, and overlapping description thereof may be omitted.

The ultrasonic element array 100 includes: the 1st to the 64th groups of the reception ultrasonic elements; the 1st to the 63th groups of the transmission ultrasonic elements; the 1st to the 64th pairs of reception electrode lines LRA1-LRA64, LRB1-LRB64; the 1st to the 63th sets of transmission electrode lines LTA1-LTA63, LTB1-LTB63, LTC1-LTC63; and the 1st to the 8th common electrode lines LY1-LY8.

In the third configuration example, two reception ultrasonic element columns SRA, SRB and three transmission ultrasonic element columns STA-STC are alternately arranged along the scanning direction D1. The transmission ultrasonic element columns STA-STC are connected to three transmission signal lines in one-to-one correspondence. The three transmission signal lines constituting a single set are connected to the same transmission terminal. For example, three transmission electrode lines LTA1-LTC1 are connected to a first transmission terminal XT1 as a single set of the transmission signal lines, and are connected to the ultrasonic element columns STA-STC, respectively.

The third configuration example is expected to be applied in a case where one of the reception channel and the transmission channel has a higher effect due to the increase in the number of the columns than the other. For example, transmission power increases by increasing the number of the transmission channels, and therefore it is conceivable to set the number of the transmission channels larger than the number of the reception channels.

In the above embodiments (the first configuration example to the third configuration example), the ultrasonic measurement device includes: the ultrasonic element array 100 that has the reception ultrasonic element column SRA (SRB) and the transmission ultrasonic element column STA (STB, STC); the reception terminal XR1 connected to the reception ultrasonic element column SRA (SRB); the transmission terminal XT1 connected to the transmission ultrasonic element column STA (STB, STC); a reception circuit (for example, an amplifier circuit AMR1 shown in FIG. 9) that receives the reception signal from the reception terminal XR1; and a transmission circuit (for example, a pulser PLS1 shown in FIG. 6) that outputs a transmission signal to the transmission terminal XT1.

The reception ultrasonic element columns SRA (SRB) and the transmission ultrasonic element columns STA (STB, STC) are alternately arranged every column (FIG. 2), or every multiple of columns (FIG. 3, FIG. 4) in the first direction D1 (i.e., the scanning direction). The reception ultrasonic element column SRA (SRB) is an ultrasonic element column in which the reception ultrasonic elements 10 are arranged along the second direction D2 that is orthogonal to the first direction D1. The transmission ultrasonic element column STA (STB, STC) is an ultrasonic element column in which the transmission ultrasonic elements 10 are arranged along the second direction D2. The reception terminal XR1 is arranged at one end HN1 of the ultrasonic element array 100 in the second direction D2. The transmission terminal XT1 is arranged at the other end HN2 of the ultrasonic element array 100 in the second direction D2.

According to the present embodiment, the reception ultrasonic element columns SRA (SRB) and the transmission ultrasonic element columns STA (STB, STC) can be alternately arranged every column, or any multiple of columns in the scanning direction. For example, when the ultrasonic element array 100 is configured with the ultrasonic element using the piezoelectric layer 30 shown in FIG. 1A etc., the element pitch can be narrowed. Accordingly, the grating lobe can be suppressed even when the above-mentioned arrangement is adopted. Furthermore, since the reception ultrasonic element column SRA (SRB) is disposed between the transmission ultrasonic element columns STA (STB, STC), cross talk between the transmission channels can be suppressed.

According to the present embodiment, the reception terminal XR1 and the transmission terminal XT1 are arranged at separate ends in the slice direction, and thus the reception signal and the transmission signal can be taken from the separate ends. Because of this, noise contamination from the transmission system with large signal amplitude to the reception system handling weak signals can be suppressed. The suppression of the noise contamination improves the S/N ratio of the reception system, and thus high-definition images can be produced. Furthermore, since the reception signal and the transmission signal are taken from the separate ends, protection circuits for protecting the reception circuit from the transmission signal with large signal amplitude (for example, T/R switches, limiter circuits, etc.) are not needed. Accordingly, the circuit can be simplified.

3. Ultrasonic Probe

Figure 5:
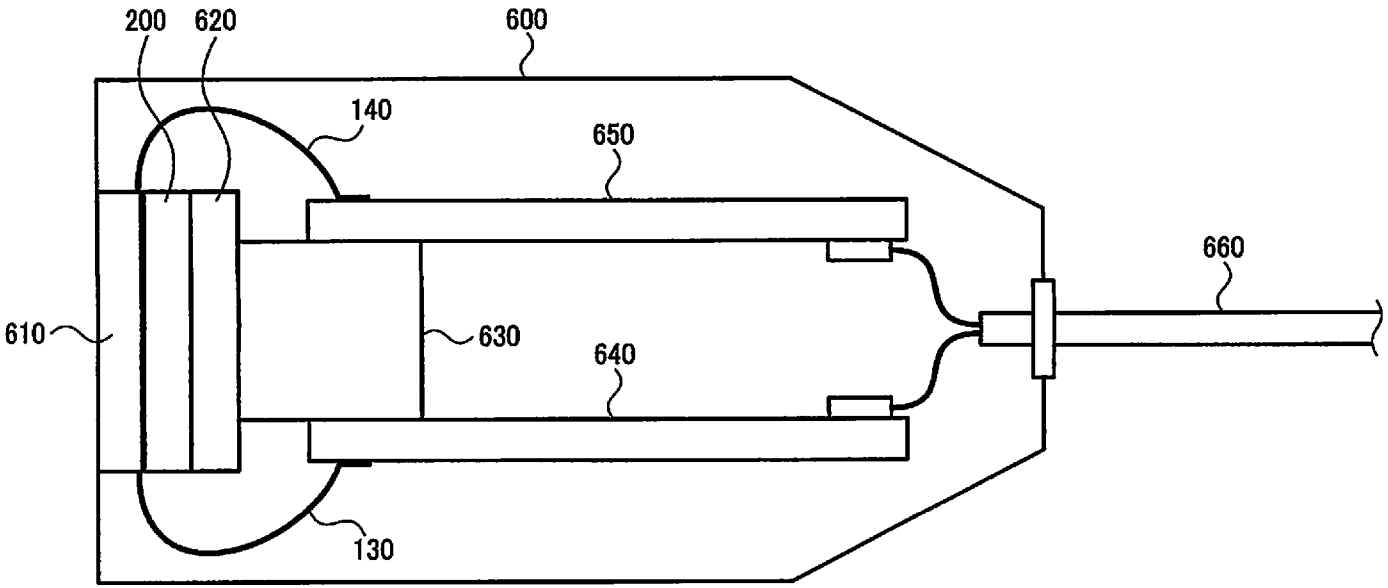
FIG. 5 shows a configuration example of an ultrasonic probe.

FIG. 5 shows a configuration example of an ultrasonic probe including the ultrasonic measurement device of the present embodiment. The ultrasonic probe includes a first flexible substrate 130, a second flexible substrate 140, the ultrasonic transducer device 200 (element chip), a case 600, an acoustic member 610, a back plate 620, a support member 630, a reception substrate 640, a transmission substrate 650, and a cable 660. Hereinafter, the ultrasonic transducer device 200 may be referred to as "element chip."

The ultrasonic measurement device includes the element chip 200, the first flexible substrate 130, and the second flexible substrate 140. On the first flexible substrate 130, the reception signal lines that connect the reception terminals XR1-XR64 of the element chip 200 and the terminals of the reception substrate 640 are formed. On the second flexible substrate 140, the transmission signal lines that connect the transmission terminals XT1-XT64 of the element chip 200 and the terminals of the transmission substrate 650 are formed.

The acoustic member 610 includes, for example, an acoustic matching layer that matches the acoustic impedance between the element chip 200 and a measuring object, an acoustic lens that focuses an ultrasonic beam, etc. The back plate 620 is provided on the back surface of the element chip 200, and suppresses the back reflection of ultrasonic waves, etc. The support member 630 is a member that supports the element chip 200, the reception substrate 640, and the transmission substrate 650.

The reception substrate 640 and the transmission substrate 650 are each formed with a rigid printed circuit board. On the reception substrate 640, a reception amplifier (analog front-end circuit) that processes the reception signal obtained from ultrasonic waves received by the element chip 200, and an integrated circuit device, such as a reception control circuit that performs reception control of the reception amplifier, are mounted, for example. On the transmission substrate 650, a pulser that outputs a drive signal to the element chip 200, a transmission control circuit that performs transmission control (for example, scanning control, delay control, etc.) of the transmission circuit, and an integrated circuit devices, such as a communication processing circuit that performs communication processing with the main part of the ultrasonic image device through the cable 660, are mounted, for example.

In the present embodiment, the reception terminals XR1-XR64 and the transmission terminals XT1-XT64 of the element chip 200 are arranged at the different long sides HN1 and HN2, and thus they can be separately connected to the reception substrate 640 and the transmission substrate 650. Because of this, the reception system and the transmission system can be arranged on separate substrates.

4. Transmission System, Reception System

Figure 6:
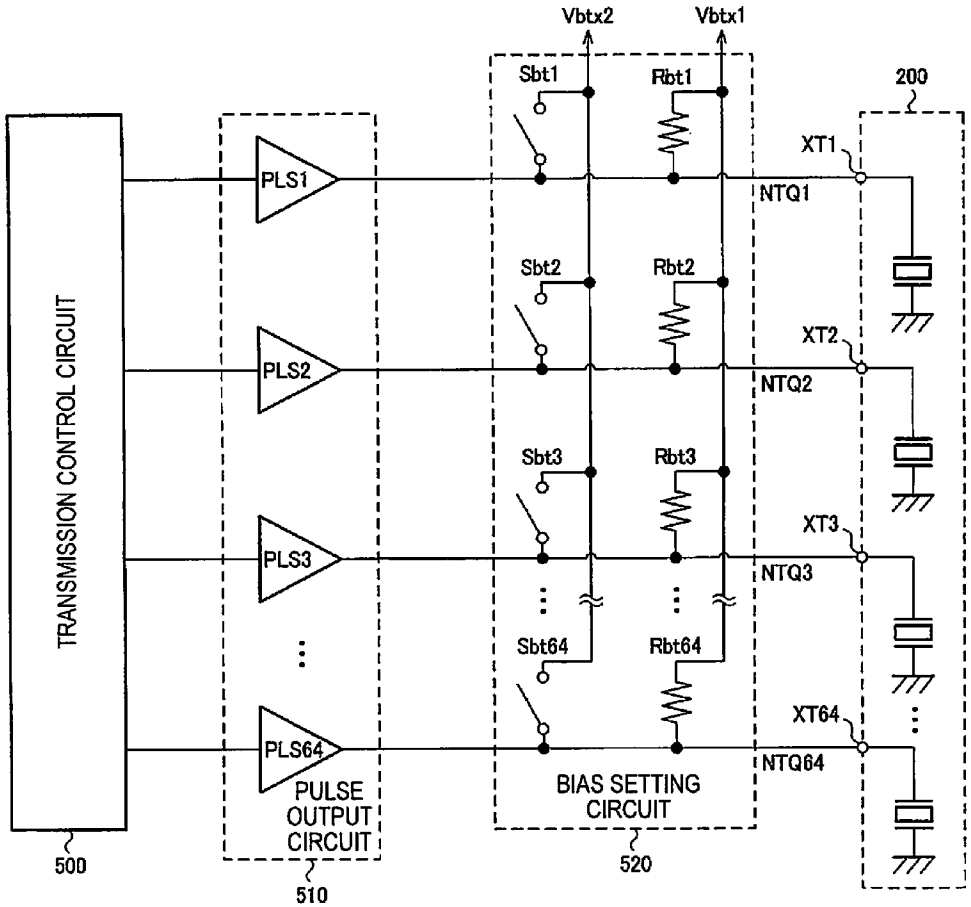
FIG. 6 shows a configuration example of a transmission system.

FIG. 6 shows a configuration example of a transmission system mounted on the transmission substrate 650. The transmission system shown in FIG. 6 includes a transmission control circuit 500, a pulse output circuit 510, and a bias setting circuit 520. As mentioned later, part or all of the transmission circuit may be mounted on the second flexible substrate 140.

The pulse output circuit 510 includes the 1st to the 64th pulsers PLS1-PLS64 (the 1st to the 64th transmission circuits) that output drive pulses (drive signals) to the 1st to the 64th transmission terminals XT1-XT64 of the element chip 200. The pulsers PLS1-PLS64 are controlled by the transmission control circuit 500. For example, when a sector scan is performed, the transmission control circuit 500 controls the timing (delay time of drive pulses) at which the pulsers PLS1-PLS64 output the drive pulses, and scans the output direction of the ultrasonic beam. Furthermore, when a linear scan is performed, the transmission control circuit 500, for example, allows the pulsers PLS1-PLS8 to output drive pulses during the first transmission period, and then allows the pulsers PLS2-PLS9 to output drive pulses during the second transmission period. After that, the transmission control circuit 500 allows the pulsers to output drive pulses while the channel is sequentially shifted one by one, thereby scanning the output position of the ultrasonic beam.

The bias setting circuit 520 sets a bias voltage to the output nodes of the pulsers PLS1-PLS64. The bias setting circuit 520 includes resistive elements Rbt1-Rbt64 provided between a node of a bias voltage Vbtx1 and the output nodes of the pulsers PLS1-PLS64, and switching elements Sbt1-Sbt64 provided between a node of a bias voltage Vbtx2 and the output nodes of the pulsers PLS1-PLS64.

The switching elements Sbt1-Sbt64 are turned ON or OFF by the transmission control circuit 500. The switching elements Sbt1-Sbt64 are turned OFF during the transmission period, and turned ON during the reception period. That is, the transmission terminals XT1-XT64 are set to the bias voltage Vbtx1 through the resistive elements Rbt1-Rbt64 during the transmission period, and the transmission terminals XT1-XT64 are set to the bias voltage Vbtx2 through the switching elements Sbt1-Sbt64 during the reception period. The bias voltages Vbtx1 and Vbtx2 are, for example, supplied from the voltage supply circuit provided on the transmission substrate 650, and may be the same voltage, or may be different voltages.

Figure 7:
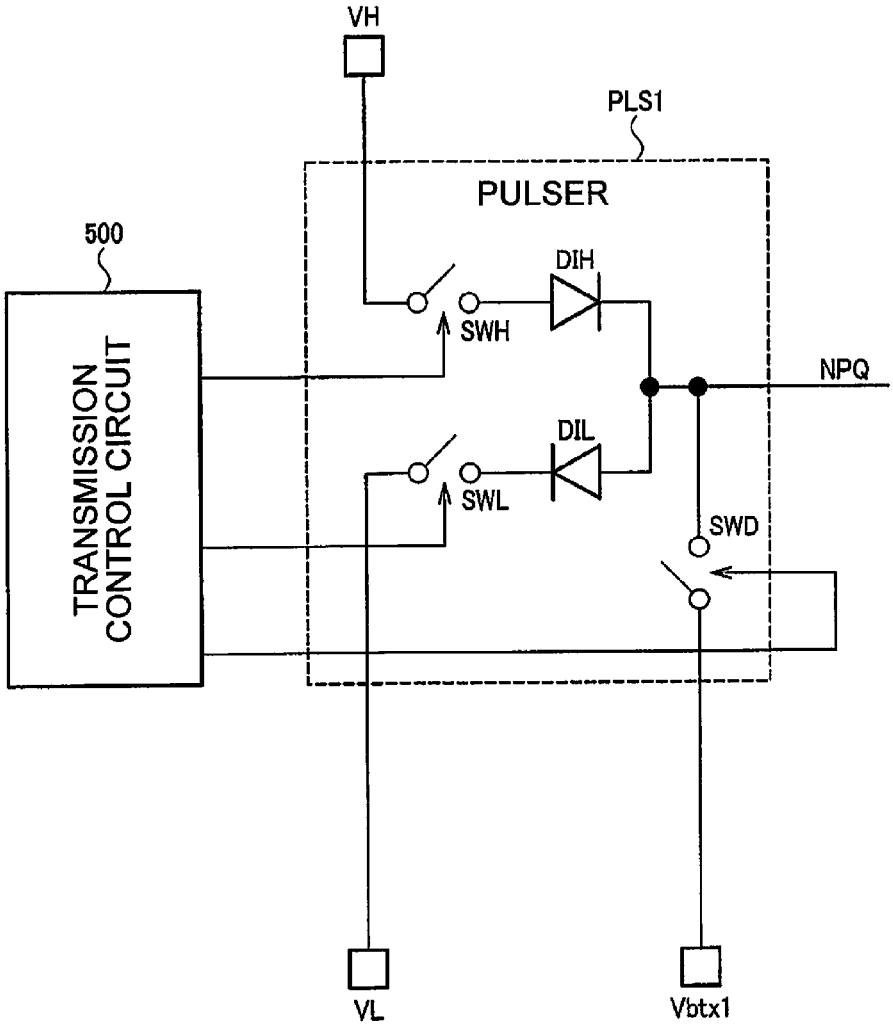
FIG. 7 shows the details of a configuration example of a pulser.

FIG. 7 shows the details of a configuration example of the pulsers PLS1-PLS64. FIG. 7 shows the pulser PLS1 as an example, and other pulsers can be configured as well.

The pulser PLS1 shown in FIG. 7 includes: a diode DIH whose cathode electrode is connected to an output node NPQ; a diode DIL whose anode electrode is connected to the output node NPQ; a switching element SWH provided between a node of a voltage VH and the anode electrode of the diode DIH; a switching element SWL provided between a node of a voltage VL and the cathode electrode of the diode DIL; and a switching element SWD (switching element for damping) provided between the output node NPQ and a node of the bias voltage Vbtx1. The voltages VH and VL are set according to the amplitude of the drive pulse, and are supplied from a voltage supply circuit provided on the transmission substrate 650, for example. The switch SWH and SWL are turned ON or OFF by the transmission control circuit 500.

Figure 8:
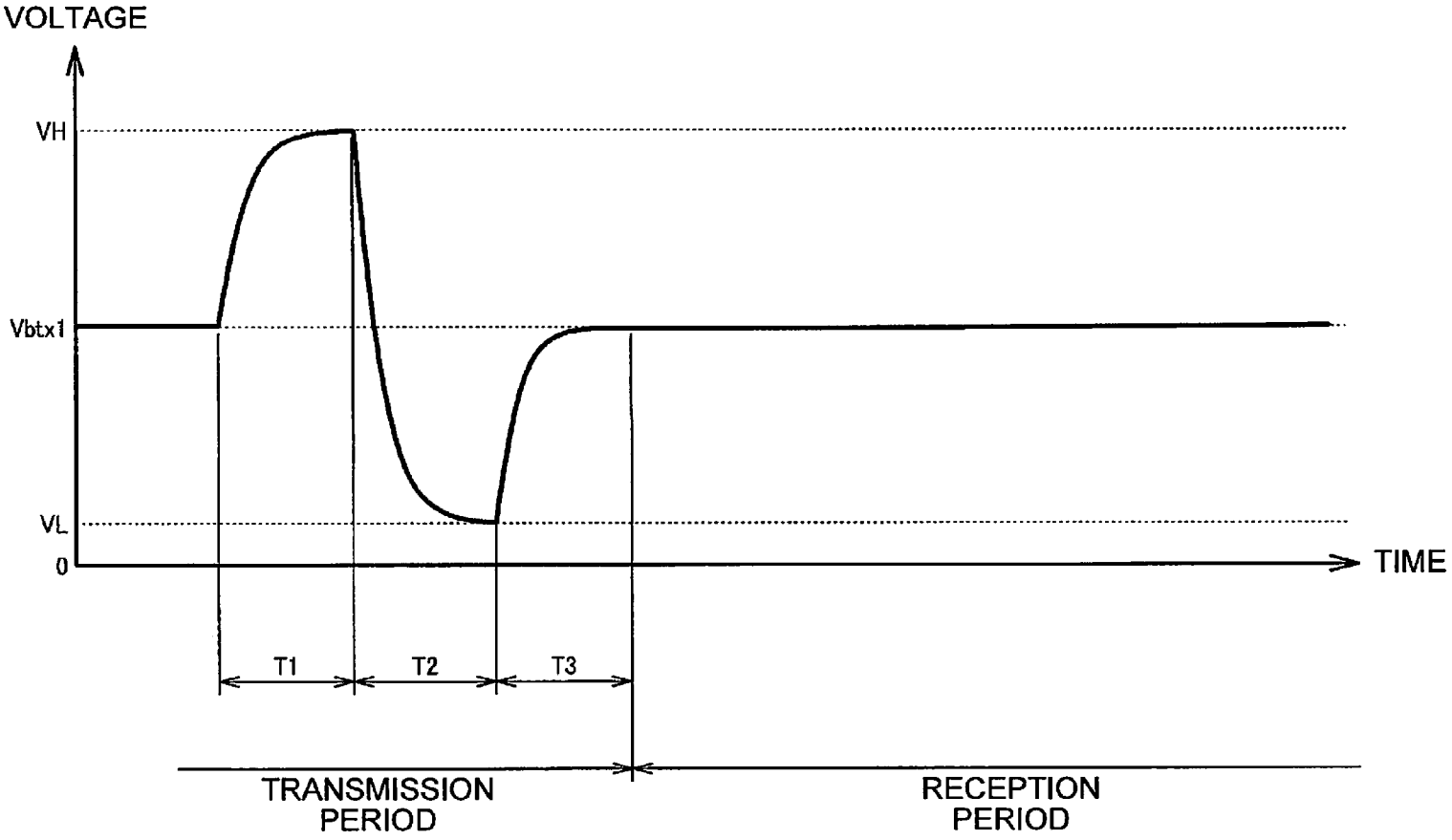
FIG. 8 shows an operation of a transmission system.

FIG. 8 shows an operation of a transmission system in which the pulser PLS1 shown FIG. 7 is used. FIG. 8 shows the pulser PLS1 as an example, the same operation can be applied to the other pulsers.

During a period T1 in the transmission period, the switch SWH is turned ON, the switch SWL is turned OFF, and the pulser PLS1 outputs the voltage VH. During a period T2 in the transmission period, the switch SWL is turned ON, the switch SWH is turned OFF, and the pulser PLS1 outputs the voltage VL. The start timing of the period T1 is set by the transmission control circuit 500 according to the delay time of the drive pulse. During a period T3 in the transmission period, the switching element SWD is turned ON, and damping the output voltage of the pulser PLS1 to the bias voltage Vbtx1. The voltage VL is a voltage higher than the common voltage (for example, ground voltage) applied to the common electrode of the ultrasonic element 10. The bias voltage Vbtx1 is (VH+VL)/2, for example. That is, each of the voltages are set so that the voltage applied between both electrodes of the transmission ultrasonic element 10 becomes 0V or more. By setting each of the voltages as above, the properties of the ultrasonic element 10, which is a thin film piezoelectric element, can be improved.

During the reception period, the switching elements SWH, SWL, and SWD are turned OFF, the switching element Sbt1 of the bias setting circuit 520 is turned ON, and the output node of the pulser PLS1 is set to the bias voltage Vbtx2. It should be noted that FIG. 8 shows a case in which Vbtx2=Vbtx1.

Figure 9:
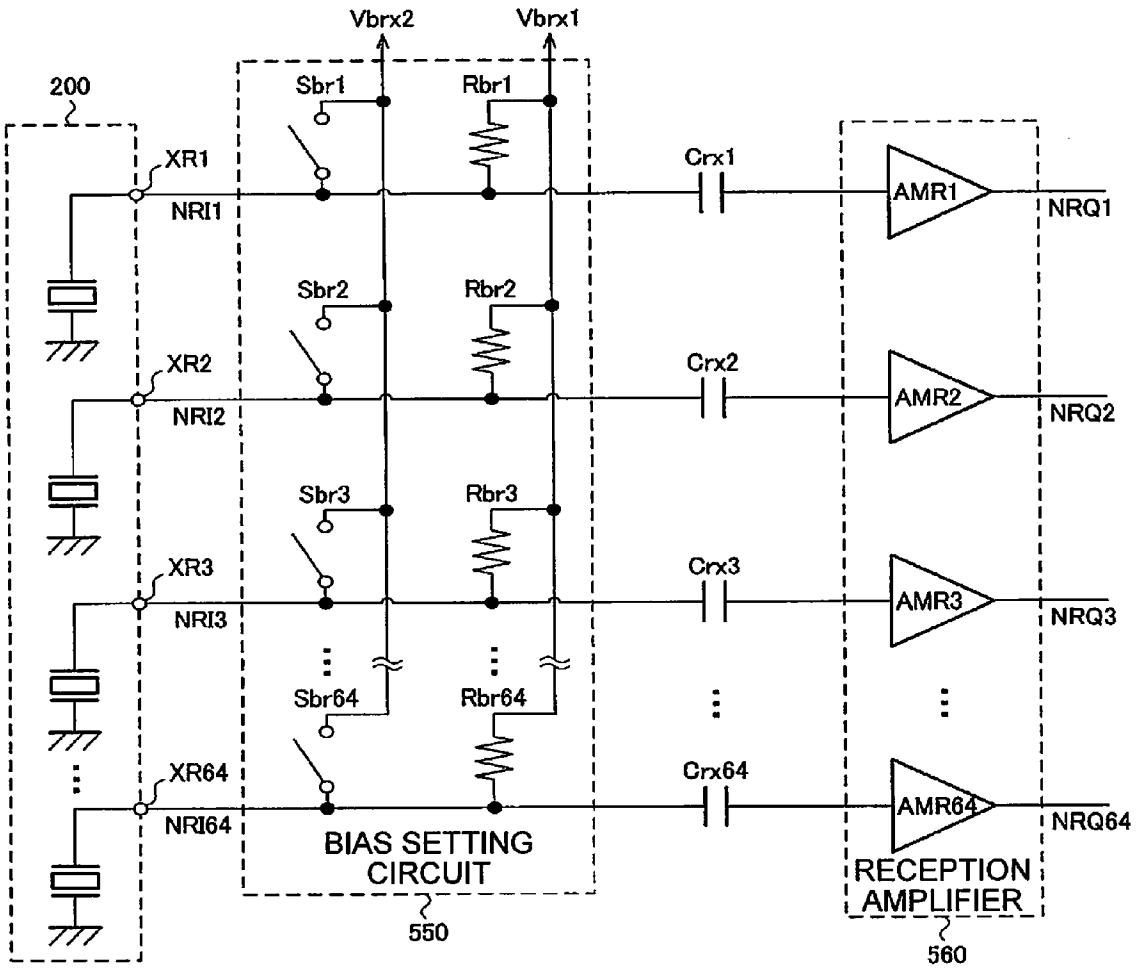
FIG. 9 shows a configuration example of a reception system.

FIG. 9 shows a configuration example of a reception system mounted on the reception substrate 640. The reception system shown in FIG. 9 includes a bias setting circuit 550, capacitors Crx1-Crx64, and a reception amplifier 560. As mentioned later, part or all of the reception system may be mounted on the first flexible substrate 130.

The reception amplifier 560 includes the 1st to the 64th amplifier circuits AMR1-AMR64 (the 1st to the 64th reception circuit) that amplify reception signals from the 1st to the 64th reception terminals XR1-XR64 of the element chip 200. The capacitors Crx1-Crx64 are provided between the amplifier circuits AMR1-AMR64 and the input nodes of the reception terminals XR1-XR64, and perform an AC coupling of the reception signals.

The bias setting circuit 550 sets a bias voltage to the reception terminals XR1-XR64. The bias setting circuit 550 includes: resistive elements Rbr1-Rbr64 provided between the reception terminals XR1-XR64 and a node of a bias voltage Vbrx1; and switching elements Sbr1-Sbr64 provided between a node of a bias voltage Vbrx2 and the reception terminals XR1-XR64.

The switching elements Sbr1-Sbr64 are turned ON or OFF by the reception control circuit (not shown) provided on the reception substrate 640, for example. The switching elements are turned ON during the transmission period, and are turned OFF during the reception period. That is, the reception terminals XR1-XR64 are set to the bias voltage Vbrx1 through the resistive elements Rbr1-Rbr64 during the reception period, and the reception terminals XR1-XR64 are set to the bias voltage Vbrx2 through the switching elements Sbr1-Sbr64 during the transmission period. The bias voltages Vbrx1 and Vbrx2 are, for example, supplied from the voltage supply circuit provided on the reception substrate 640, and may be the same voltage, or may be different voltages.

Figure 10:
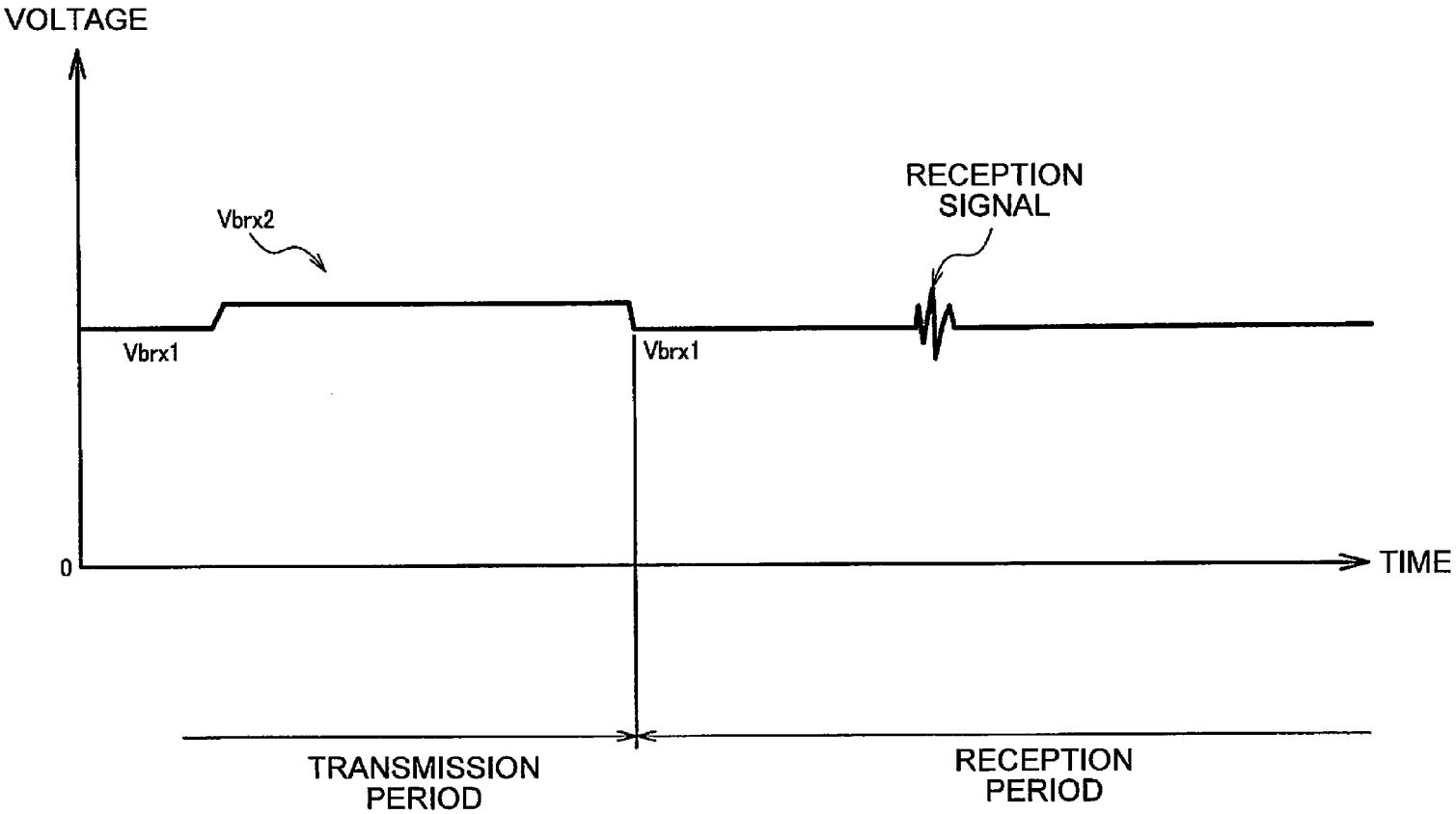
FIG. 10 shows an operation of a reception system.

FIG. 10 shows an operation of the reception system. During the transmission period, the switching elements Sbr1-Sbr64 are turned ON, and the reception terminals XR1-XR64 are set to the bias voltage Vbrx2. Because of this, for example, the reception electrode lines LRA1-LRA64 shown in FIG. 2 are set to the bias voltage Vbrx2 during the transmission period, and thus any cross coupling between the transmission electrode lines LTA1-LTA64 can be suppressed, thereby more precise beam form can be realized.

During the reception period, the switching elements Sbr1-Sbr64 are turned OFF, and the reception terminals XR1-XR64 are set to the bias voltage Vbrx1 through the resistive elements Rbr1-Rbr64. In the present embodiment, the transmission ultrasonic element columns and the reception ultrasonic element columns are separated, and thus it is possible to apply different bias voltages to them. For example, the bias voltage Vbrx1 is set to a voltage at which the reception sensitivity of the ultrasonic element 10, which is a thin film piezoelectric element, becomes the highest.

The above description describes examples in which a sector scan or a linear scan is conducted. However, the present embodiment is not limited to the above examples, and the present embodiment can be used with a continuous-wave mode. In the continuous-wave mode, the reception period and the transmission period are not separated. That is, the transmission circuit outputs drive pulses continuously, and the reception system receives reception signals continuously.

In the above-mentioned embodiment, the ultrasonic measurement device includes the first bias setting circuit 550 and the second bias setting circuit 520. The first bias setting circuit 550 is provided between the reception circuit (for example, the amplifier circuit AMR1) and the reception terminal XR1, and sets the node NRI1 of the reception terminal to the bias voltage Vbrx1. The second bias setting circuit 520 is provided between the transmission circuit (for example, the pulser PLS1) and the transmission terminal XT1, and sets the node NTQ1 of the transmission terminal to the second bias voltage Vbtx1.

According to this configuration, the bias voltage for the transmission ultrasonic elements and that for the reception ultrasonic elements can be set independently, and thus the transmission properties and the reception properties of the ultrasonic elements can be optimized. In particular, the reception sensitivity can be maximized by optimizing the bias voltage Vbrx1 of the reception ultrasonic elements.

Furthermore, in the present embodiment, the first bias setting circuit 550 includes a setting circuit that sets the node NRI1 of the reception terminal XR1 to a fixed potential (the bias voltage Vbrx2) during the ultrasonic wave transmission period. Specifically, the first bias setting circuit 550 includes the resistive element Rbr1 provided between a node of the supply line of the first bias voltage Vbrx1 and the node NRI1 of the reception terminal XR1; and the setting circuit includes the switching element Sbr1. The switching element Sbr1 is provided between a node of the supply line of a fixed potential (Vbrx2) and the node NRI1 of the reception terminal XR1, and is turned ON during the ultrasonic wave transmission period.

According to this configuration, the reception electrode line connected to the reception ultrasonic element column can be connected to a fixed potential (the bias voltage Vbrx2) with low impedance during the transmission period. Because of this, the reception electrode line at the fixed potential is disposed between the transmission electrode lines connected to the transmission ultrasonic element columns. Accordingly, any cross talk of the transmission signals is suppressed, and the quality of the ultrasonic image can be improved.

Figure 11:
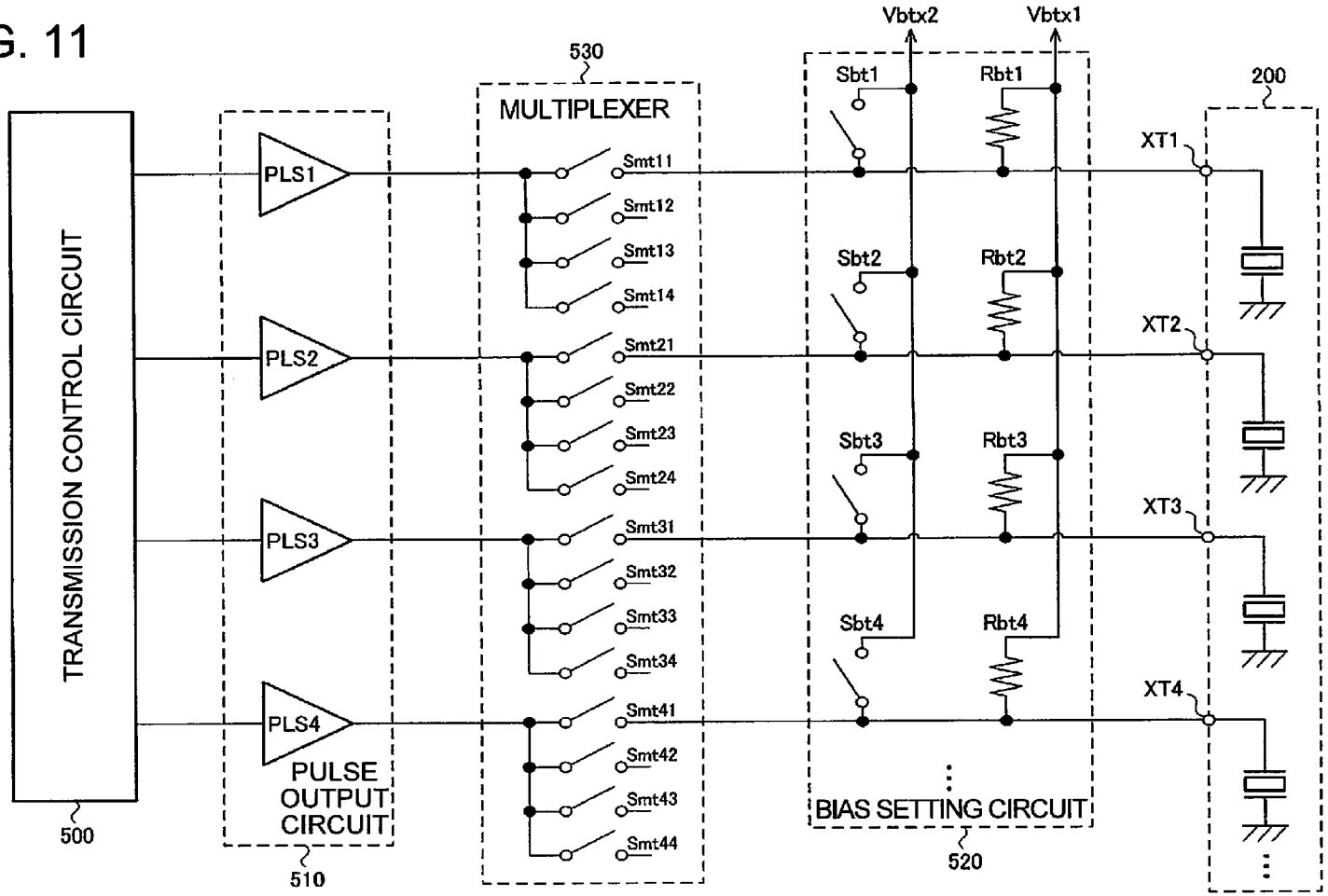
FIG. 11 shows a modified configuration example of a transmission system.

5. Modified Configuration Example of Transmission System and Reception System FIG. 11 shows a modified configuration example of the transmission system. A transmission system shown in FIG. 11 includes the transmission control circuit 500, the pulse output circuit 510, the bias setting circuit 520, and a multiplexer 530. The same components as those shown in FIG. 6 are designated by the same reference numerals and symbols, and overlapping description thereof may be omitted. The following description describes an example in which the number of pulsers is 4, the number of multiplexes is 4, and the number of transmission channels of the element chip 200 is 16. However, the present embodiment is not limited to the following example.

The pulse output circuit 510 includes the pulsers PLS1-PLS4 that output drive pulses to the multiplexer 530. The multiplexer 530 includes switching elements Smt11-Smt14, switching elements Smt21-Smt24, switching elements Smt31-Smt34, and switching elements Smt41-Smt44. The switching elements Smt11-Smt14 are provided between the output node of the pulser PLS1 and transmission terminals XT1, XT5, XT9, XT13. The switching elements Smt21-

Smt24 are provided between the output node of the pulser PLS2 and transmission terminals XT2, XT6, XT10, XT14. The switching elements Smt31-Smt34 are provided between the output node of the pulser PLS3 and transmission terminals XT3, XT7, XT11, XT15. The switching elements Smt41-Smt44 are provided between the output node of the pulser PLS4 and transmission terminals XT4, XT8, XT12, XT16. It should be noted that illustration of the connections of the switching elements is partially omitted.

Figure 12:
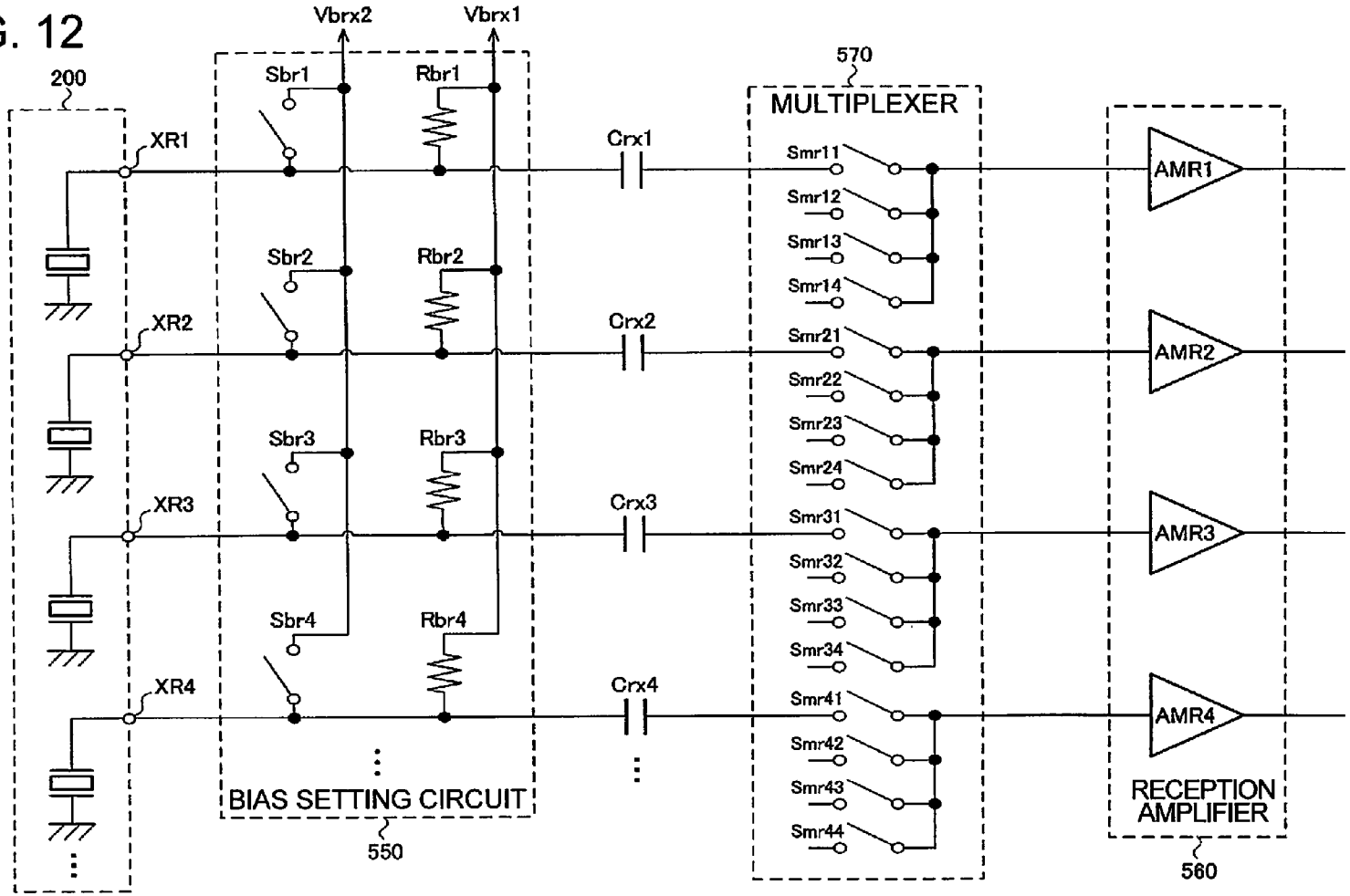
FIG. 12 shows a modified configuration example of a reception system.

FIG. 12 shows a modified configuration example of the reception system. The reception system shown in FIG. 12 includes the bias setting circuit 550, the reception amplifier 560, and a multiplexer 570. The same components as those shown in FIG. 9 are designated by the same reference numerals and symbols, and overlapping description thereof may be omitted.

The reception amplifier 560 includes the amplifier circuits AMR1-AMR4 that amplify the reception signal from the multiplexer 570. The multiplexer 570 includes switching elements Smr11-Smr14, switching elements Smr21-Smr24, switching elements Smr31-Smr34, and switching elements Smr41-Smr44. The switching elements Smr11-Smr14 are provided between the input node of the amplifier circuit AMR1 and reception terminals XR1, XR5, XR9, XR13. The switching elements Smr21-Smr24 are provided between the input node of the amplifier circuit AMR2 and reception terminals XR2, XR6, XR10, XR14. The switching elements Smr31-Smr34 are provided between the input node of the amplifier circuit AMR3 and reception terminals XR3, XR7, XR11, XR15. The switching elements Smr41-Smr44 are provided between the input node of the amplifier circuit AMR4 and reception terminals XR4, XR8, XR12, XR16. It should be noted that illustration of the connections of the switching elements is partially omitted for simplicity.

When a linear scan is performed, for example, the switching elements Smt11, Smt21, Smt31, and Smt41 of the transmission system are turned ON during the first transmission period, and the pulsers PLS1, PLS2, PLS3, and PLS4 output drive pulses to the transmission terminals XT1, XT2, XT3, and XT4. During the first reception period, the switching elements Smr11 Smr21, Smr31, and Smr41 of the reception system are turned ON, and the amplifier circuits AMR1, AMR2, AMR3, and AMR4 receive reception signals from the reception terminals XR1, XR2, XR3, and XR4. During the second transmission period after the first transmission period, the switching elements Smt21, Smt31, Smt41, and Smt12 of the transmission system are turned ON, and the pulsers PLS2, PLS3, PLS4, and PLS1 output drive pulses to the transmission terminals XT2, XT3, XT4, and XT5. During the second reception period, the switching elements Smr21 Smr31, Smr41, and Smr12 of the reception system are turned ON, the amplifier circuits AMR2, AMR3, AMR4, and AMR1 receive reception signals from the reception terminal XR2, XR3, XR4, and XR5. Thereafter, the transmission of drive pulses and the reception of reception signals are performed while the channel is shifted one by one, and thereby the linear scan is performed.

According to the configuration that performs the multiplex as mentioned above, the number of the pulsers and the amplifier circuits can be reduced, and thus the number of components mounted on the reception substrate 640 and the transmission substrate 650 can be reduced. Furthermore, as mentioned later, when the reception system and the transmission system are each formed into a single chip and are mounted on the first flexible substrate 130 and the second flexible substrate 140 respectively, the chip size can be reduced.

6. Configuration Example of Ultrasonic Measurement Device

The above description describes an example in which the reception system and the transmission system are mounted on the reception substrate 640 and the transmission substrate 650 of a probe body, respectively. However, the present embodiment is not limited to the above-mentioned example. For example, the reception system (part or all thereof) may be mounted on the first flexible substrate 130 that connects the element chip 200 and the reception substrate 640, and the transmission system (part or all thereof) may be mounted on the second flexible substrate 140 that connects the element chip 200 and the transmission substrate 650.

Figure 13:
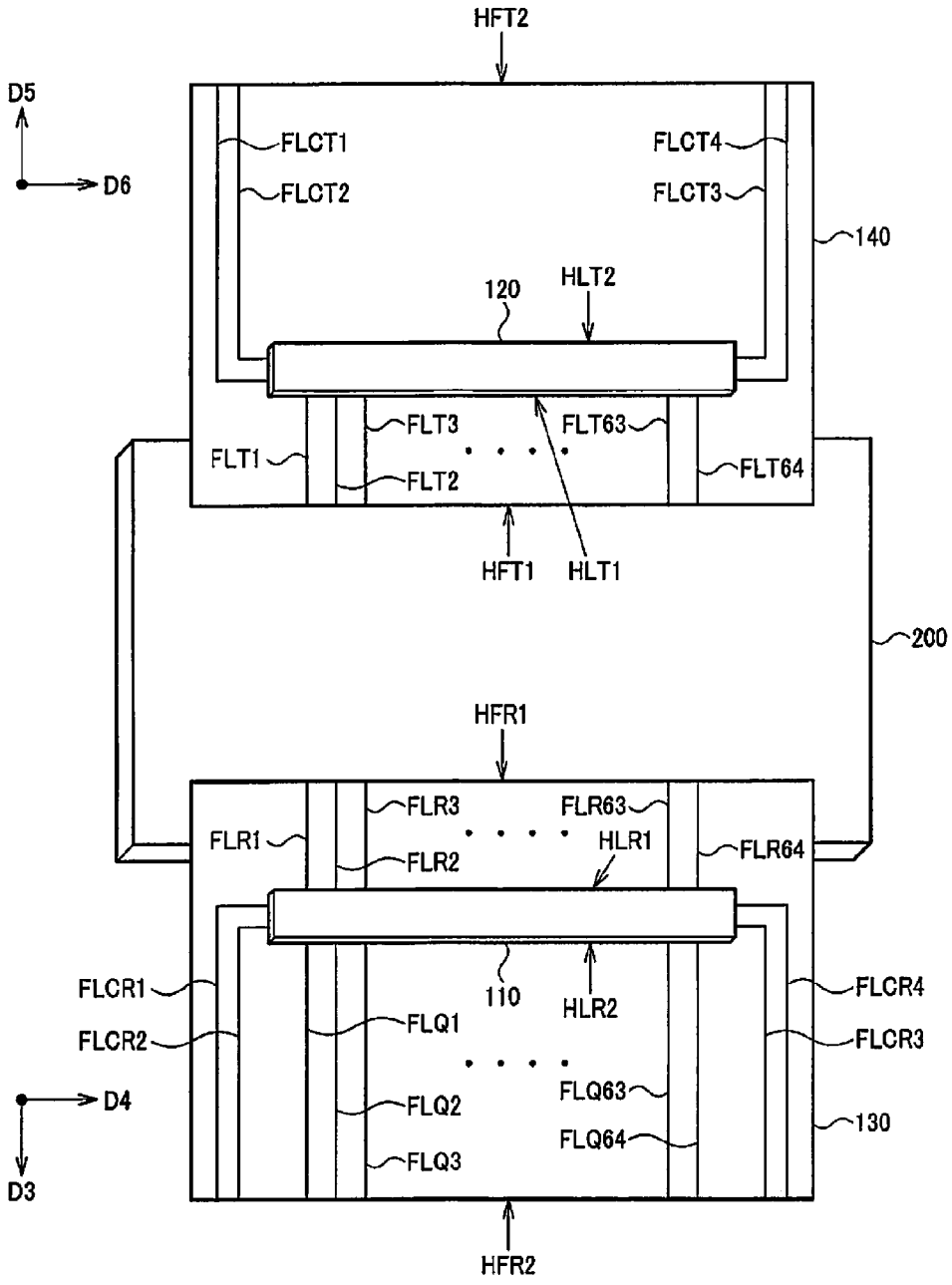
FIG. 13 shows a configuration example of an ultrasonic measurement device.

FIG. 13 shows a configuration example of an ultrasonic measurement device in such a case. The ultrasonic measurement device includes the element chip 200, the first flexible substrate 130, the second flexible substrate 140, the first integrated circuit device 110, and the second integrated circuit device 120.

First, the first flexible substrate 130 and the first integrated circuit device 110 are described. As shown in FIG. 13, a direction on the first flexible substrate 130 is referred to as the third direction D3, the direction that crosses (for example, crosses orthogonally with) the third direction D3 is referred to as the 4th direction D4. The first flexible substrate 130 is connected to the element chip 200 at one end HFR1 in the third direction D3, and is connected to the reception substrate 640 at the other end HFR2. The first integrated circuit device 110 is mounted on the first flexible substrate 130 so that its long side direction runs along the 4th direction D4.

Specifically, the 1st to the 64th reception signal lines FLR1-FLR64 are formed on the first flexible substrate 130 along the third direction D3, and one of the ends of the 1st to the 64th reception signal lines FLR1-FLR64 are connected to the 1st to the 64th reception terminals XR1-XR64 of the element chip 200. The 1st to the 64th reception terminals XR1-XR64 are formed on a surface of the element chip 200, the surface being on the side from which the ultrasonic waves are emitted. The first flexible substrate 130 is connected to the element chip 200 at one surface of the first flexible substrate 130, the surface being on the side from which the ultrasonic waves are emitted.

The first integrated circuit device 110 includes the bias setting circuit 550 shown in FIG. 9 and the reception amplifier 560. The capacitors Crx1-Crx64 may be mounted on the first flexible substrate 130 as external components, or may be built in the first integrated circuit device 110. The first integrated circuit device 110 includes the 1st to the 64th input terminals (not shown) and the 1st to the 64th output terminals (not shown). The 1st to the 64th input terminals are connected to the input nodes NRI1-NRI64 of the bias setting circuit 550, respectively. The 1st to the 64th output terminals are connected to the output nodes NRQ1-NRQ64 of the reception amplifier 560, respectively. The 1st to the 64th input terminals are arranged along the first long side HLR1 of the first integrated circuit device 110, and are connected to the other ends of the 1st to the 64th reception signal lines FLR1-FLR64 of the first flexible substrate 130, respectively. The 1st to the 64th output terminals are arranged along the second long side HLR2 of the first integrated circuit device 110.

The 1st to the 64th output signal lines FLQ1-FLQ64 are formed on the first flexible substrate 130 along the third direction D3. One of the ends of the 1st to the 64th output signal lines FLQ1-FLQ64 are connected to the 1st to the 64th output terminals of the first integrated circuit device 110, respectively. The other ends of the 1st to the 64th output signal lines FLQ1-FLQ64 are connected to the reception substrate 640 through a connector etc., for example.

Furthermore, control signal lines FLCR1-FLCR4 may be formed on the first flexible substrate 130. Through the control signal lines FLCR1-FLCR4, control signals are transmitted from the reception control circuit of the reception substrate 640 to the switching elements Sbr1-Sbr64 of the bias setting circuit 550, for example.

The first integrated circuit device 110 can be mounted with flip-chip mounting (bare chip mounting) using an anisotropic conductive film (ACF). Here, the flip-chip mounting is, for example, face-down mounting, in which mounting is conducted so as to allow the element forming surface to face the first flexible substrate 130. Alternatively, face-up mounting may be used. In the face-up mounting, mounting is conducted so as to allow the back surface of the element forming surface to face the first flexible substrate 130.

By conducting flip-chip mounting as mentioned above, the mounting area can be reduced compared with the case in which the first integrated circuit device 110 in a flat package is mounted on a rigid substrate. Furthermore, since the element chip 200 of the present embodiment can be driven at about 10-30V, the first integrated circuit device 110 can be miniaturized. Accordingly, the miniaturization with flip-chip mounting is easily achieved, while it is difficult with a bulk piezoelectric element, which requires an integrated circuit device with a high breakdown voltage.

Next, the second flexible substrate 140 and the second integrated circuit device 120 are described. As shown in FIG. 13, a direction on the second flexible substrate 140 is referred to as the 5th direction D5, and the direction that crosses (for example, crosses orthogonally with) the 5th direction D5 is referred to as the 6th direction D6. The second flexible substrate 140 is connected to the element chip 200 at one end HFT1 in the 5th direction D5, and is connected to the transmission substrate 650 at the other end HFT2. The second integrated circuit device 120 is mounted on the second flexible substrate 140 so that its long side direction runs along the 6th direction D6.

Specifically, the 1st to the 64th transmission signal lines FLT1-FLT64 are formed on the second flexible substrate 140 along the 5th direction D5, and one of the ends of the 1st to the 64th transmission signal lines FLT1-FLT64 are connected to the 1st to the 64th transmission terminals XT1-XT64 of the element chip 200. The 1st to the 64th transmission terminals XT1-XT64 are formed on a surface of the element chip 200, the surface being on the side from which the ultrasonic waves are emitted. The second flexible substrate 140 is connected to the element chip 200 at a surface of the second flexible substrate 140, the surface being on the side from which the ultrasonic waves are emitted.

The second integrated circuit device 120 includes the pulse output circuit 510 shown in FIG. 6 and the bias setting circuit 520. Furthermore, the second integrated circuit device 120 includes the 1st to the 64th output terminals (not shown) that are connected to the output nodes NTQ1-NTQ64 of the pulse output circuit 510, respectively. The 1st to the 64th output terminals are arranged along the first long side HLT1 of the second integrated circuit device 120, and are connected to the other ends of the 1st to the 64th transmission signal lines FLT1-FLT64 of the second flexible substrate 140, respectively.

Furthermore, control signal lines FLCT1-FLCT4 may be formed on the second flexible substrate 140. Through the control signal lines FLCR1-FLCR4, control signals are transmitted from the transmission control circuit 500 of the transmission substrate 650 to the pulse output circuit 510 and the bias setting circuit 520, for example. Alternatively, the second integrated circuit device 120 may include the transmission control circuit 500, and the control signals may be transmitted from the control part of the transmission substrate 650 to the transmission control circuit 500 through the control signal lines FLCT1-FLCT4.

The second integrated circuit device 120 can be mounted with flip-chip mounting, as the first integrated circuit device 110 mentioned above. In addition, dummy terminals (for example, as many dummy terminals as the output terminals) may be arranged along the long side HLT2 of the second integrated circuit device 120. According to this configuration, when the anisotropic conductive film is cured and shrunk to electrically connect a terminal with a wiring, the power of the cure shrinkage in the first long side HLT1 and that in the second long side HLT2 becomes equal, and thus the reliability of the electrical connection can be improved.

7. Layout Configuration Example of Integrated Circuit Device

Figure 14:
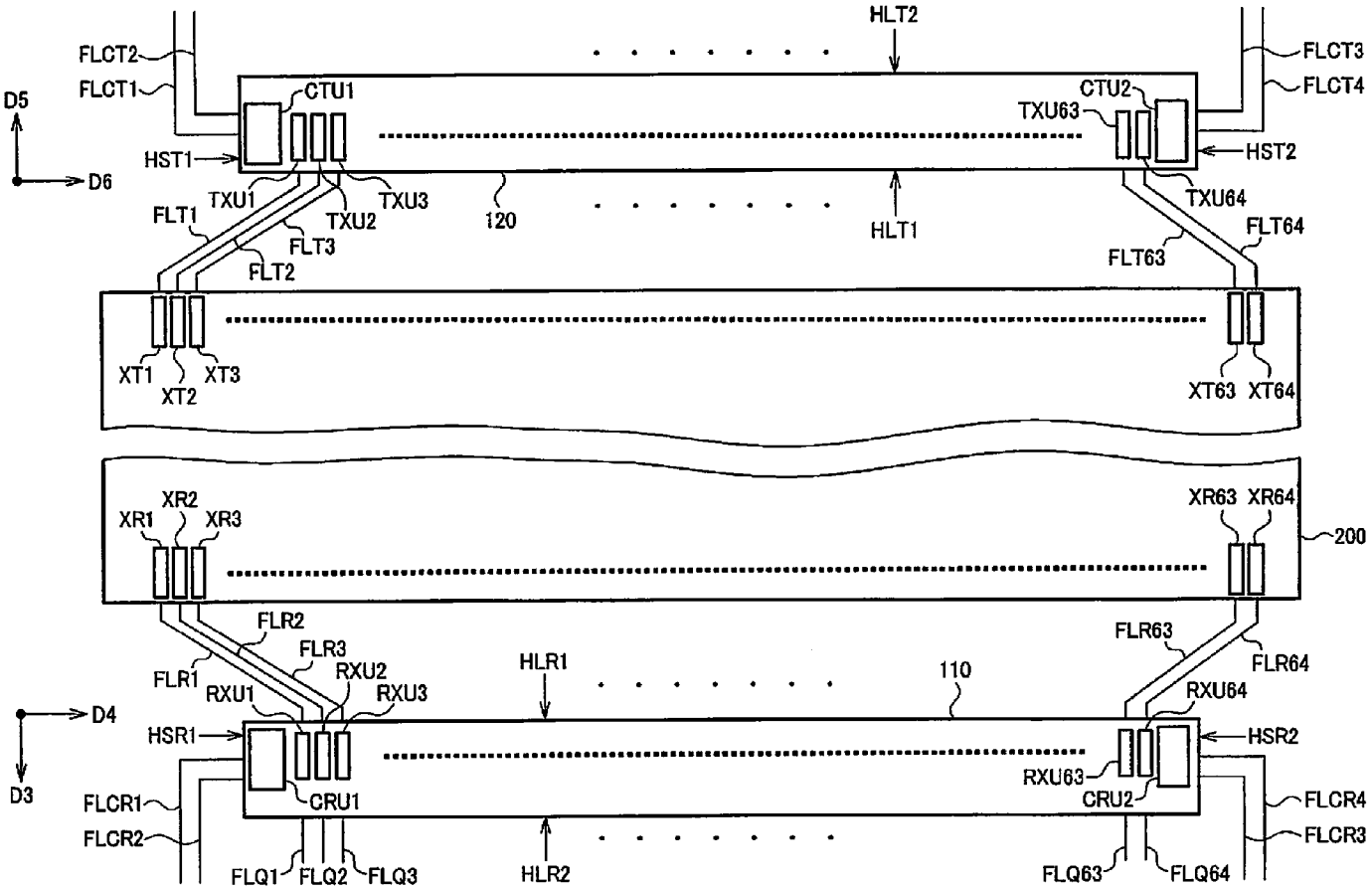
FIG. 14 shows an example of layouts of the first integrated circuit device and the second integrated circuit device.

FIG. 14 shows a layout configuration example of the first integrated circuit device 110 and the second integrated circuit device 120.

The first integrated circuit device 110 includes: the 1st to the 64th reception circuits RXU1-RXU64 arranged along the 9th direction D4 (the long side direction of the first integrated circuit device 110); the first control circuit CRU1 arranged at the first short side HSR1; and the second control circuit CRU2 arranged at the second short side HSR2.

The reception circuit RXU1 is a unit obtained by unitizing the switching element Sbr1, the resistive element Rbr1, and the amplifier circuit AMR1 shown in FIG. 9. The same applies to the other reception circuits RXU2-RXU64. The control circuit CRU1 and CRU2 are logic circuits that receive control signals from the reception control circuit of the reception substrate 640 and output control signals to the reception circuits RXU1-RXU64. It should be noted that one of the control circuits CRU1 and CRU2 can be omitted.

The second integrated circuit device 120 includes: the 1st to the 64th transmission circuits TXU1-TXU64 arranged along the 6th direction D6 (the long side direction of the second integrated circuit device 120); a control circuit CTU1 arranged at the first short side HST1; and a control circuit CTU2 arranged at the second short side HST2.

The transmission circuit TXU1 is a unit obtained by unitizing the pulser PLS1, the switching element Sbt1, and the resistive element Rbt1 shown in FIG. 6. The same applies to the other transmission circuits TXU2-TXU64. The first control circuit CTU1 and the second control circuit CTU2 are the transmission control circuit 500, and are each configured with a logic circuit, for example. It should be noted that one of the first control circuit CTU1 and the second control circuit CTU2 can be omitted.

According to this layout configuration example, the first integrated circuit device 110 and the second integrated circuit device 120 can be formed in a rectangular shape that is elongated along their long side direction, and the reception circuits RXU1-RXU64 and the transmission circuits TXU1-TXU64 can be allowed to face the reception terminals XR1-XR64 and the transmission terminals XT1-XT64 of the element chip 200. This allows the wiring between terminals to be simple, and thus the first integrated circuit device 110 and the second integrated circuit device 120 can be compactly mounted on the first flexible substrate 130 and the second flexible substrate 140.

The above description describes an example in which the reception system shown in FIG. 9 and the transmission system shown in FIG. 6 are applied to the first integrated circuit device 110 and the second integrated circuit device 120. However, the present embodiment is not limited to the above example. For example, the reception system shown in FIG. 12 and the transmission system shown in FIG. 11 may be applied to the first integrated circuit device 110 and the second integrated circuit device 120. That is, the first integrated circuit device 110 and the second integrated circuit device 120 may include the multiplexers 570 and 530, respectively.

8. Ultrasonic Head Unit

Figure 15:
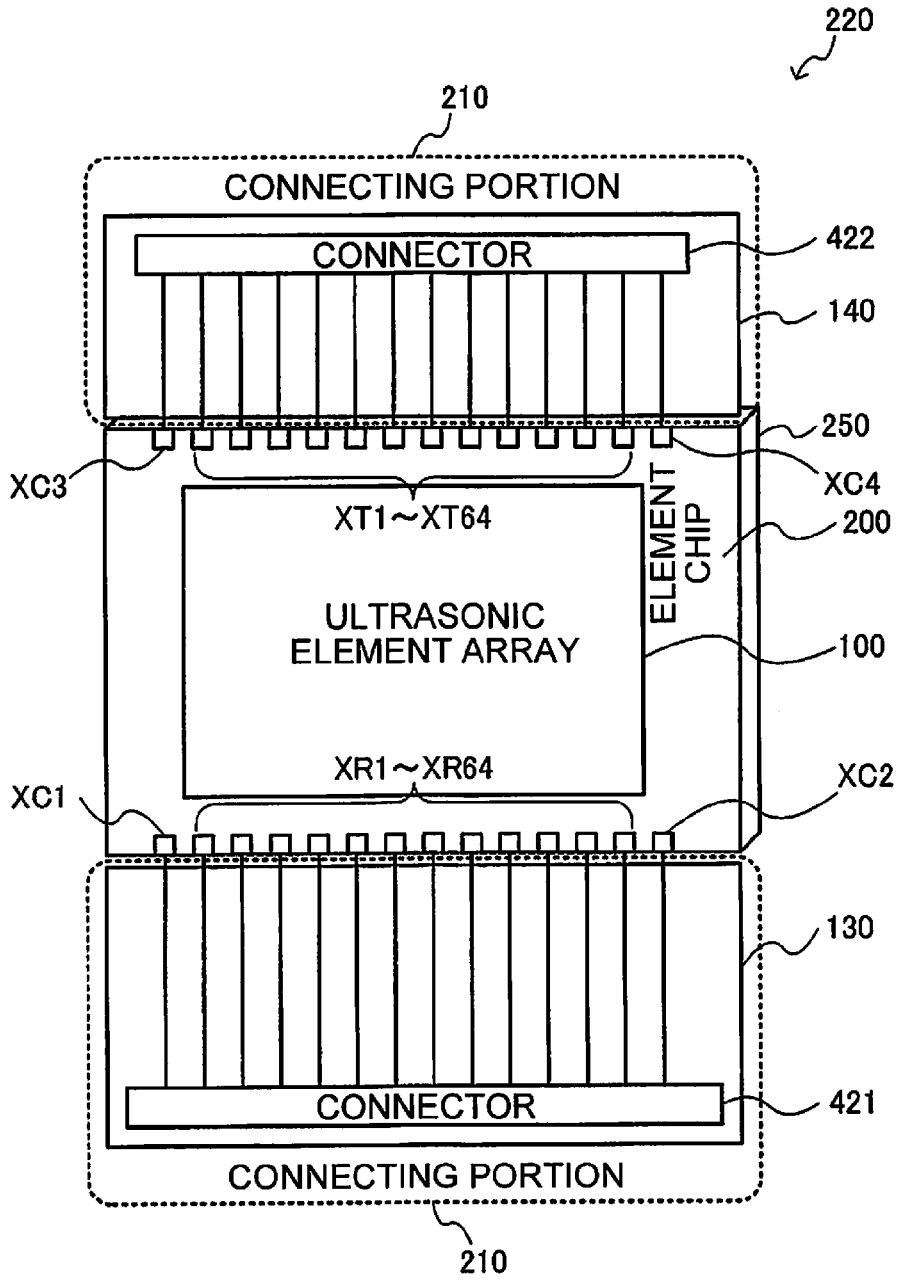
FIG. 15 shows a configuration example of an ultrasonic head unit.

FIG. 15 shows a configuration example of an ultrasonic head unit 220 equipped with the ultrasonic measurement device of the present embodiment. The ultrasonic head unit 220 shown in FIG. 15 includes the element chip 200, a connecting section 210, and a support member 250. It should be noted that the ultrasonic head unit 220 of the present embodiment is not limited to the configuration shown in FIG. 15, and various modifications can be applied to the configuration. For example, some components thereof can be omitted or replaced with other components, and other components can be added.

The element chip 200 corresponds to the ultrasonic transducer devices shown in FIG. 2 to FIG. 4. The element chip 200 includes the ultrasonic element array 100, the first chip terminal group XR1-XR64 (a plurality of reception terminals), the second chip terminal group XT1-XT64 (a plurality of transmission terminals), and the common terminals XC1-XC4. The element chip 200 is electrically connected to a processing device (the processing device 330 shown in FIG. 18, for example) of a probe body through the connecting section 210.

The connecting section 210 electrically connects the probe body and the ultrasonic head unit 220. The connecting section 210 has a connector (which has a plurality of connecting terminals) and a flexible substrate on which a wiring that connects the connector and the element chip 200 is formed. Specifically, the connecting section 210 has the first connector 421 and second connector 422 as connectors, and has the first flexible substrate 130 and second flexible substrate 140 as flexible substrates.

In the first flexible substrate 130, the first wiring group (a plurality of reception signal lines) is formed. The first wiring group connects the terminal group of the connector 421 and the first chip terminal group XR1-XR64 provided at the first side of the element chip 200. In the second flexible substrate 140, the second wiring group (a plurality of transmission signal lines) is formed. The second wiring group connects the terminal group of the connector 422 and the second chip terminal group XT1-XT64 provided at the second side of the element chip 200.

The connecting section 210 is not limited to the configuration shown in FIG. 15, and may be a configuration that does not include the connectors 421 and 422, for example. In this case, the first flexible substrate 130 may include the first connecting terminal group to which the reception signals from the first chip terminal group XR1-XR64 are output, and the second flexible substrate 140 may include the second connecting terminal group to which the transmission signals from the second chip terminal group XT1-XT64 are output.

As mentioned above, the connecting section 210 allows the probe body and the ultrasonic head unit 220 to be electrically connected, and allows the ultrasonic head unit 220 to be detachably attached to the probe body.

Figure 16C:
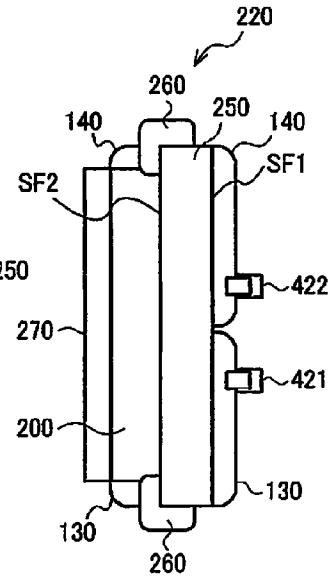
FIG. 16A to FIG. 16C show the details of a configuration example of an ultrasonic head unit.
Figure 16B:
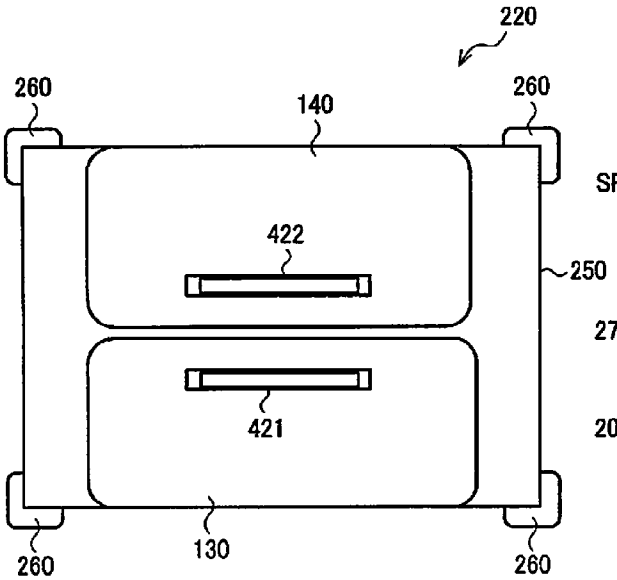
Figure 16A:
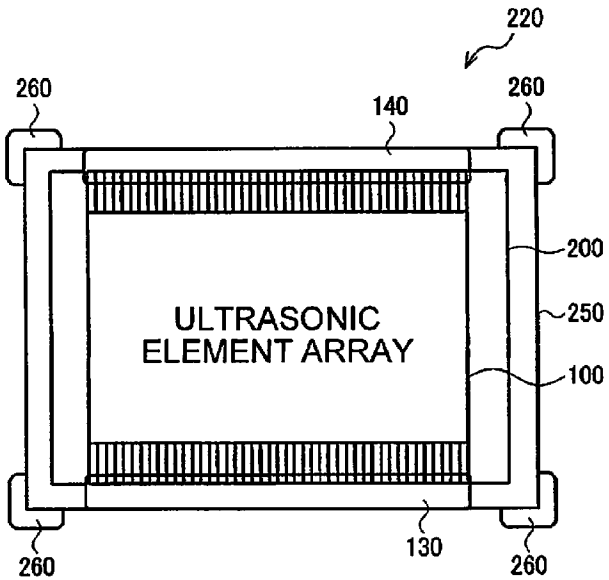

FIG. 16A-FIG. 16C show the details of a configuration example of the ultrasonic head unit 220. FIG. 16A shows the second surface SF2 of the support member 250, FIG. 16B shows the first surface SF1 of the support member 250, and FIG. 16C shows the side surface of the support member 250. The ultrasonic head unit 220 according to the present embodiment is not limited to the configuration shown in FIG. 16A to FIG. 16C, and various modifications can be applied to the configuration. For example, some components thereof can be omitted or replaced with other components, and other components can be added.

The support member 250 is a component that supports the element chip 200. The connectors 421 and 422 (a plurality of connecting terminals in abroad sense) are provided on the first surface SF1 side of the support member 250. The connectors 421 and 422 are detachably attached to the corresponding connectors in the probe body. The element chip 200 is supported by the second surface SF2 side, where the second surface SF2 is the back surface of the first surface SF1 of the support member 250. A fixing member 260 is provided at each corner of the support member 250, and is used for fixing the ultrasonic head unit 220 to a probe case.

The first surface SF1 side of the support member 250 is a normal direction side of the first surface SF1 of the support member 250. The second surface SF2 side of the support member 250 is a normal direction side of the second surface SF2 that is the back surface of the first surface SF1 of the support member 250.

As shown in FIG. 16C, a protective member (protective film) 270 for protecting the element chip 200 is provided on a surface of the element chip 200 (surface on which the piezoelectric layer 30 is formed in FIG. 1B). The protective member may serve also as an acoustic matching layer.

9. Ultrasonic Probe

Figure 17A:
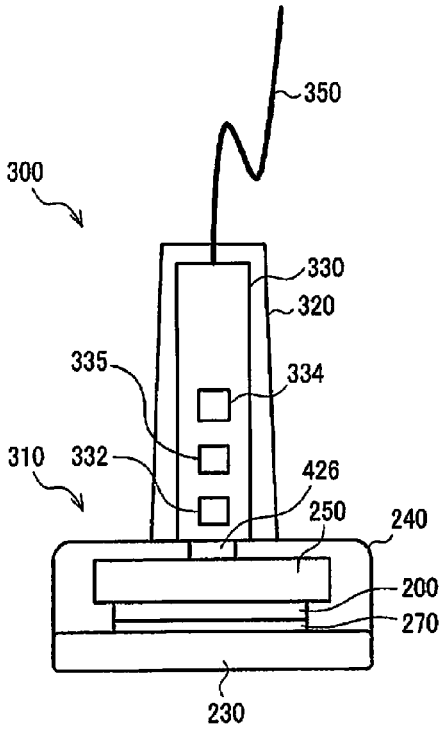
FIG. 17A and FIG. 17B show a configuration example of an ultrasonic probe.
Figure 17B:
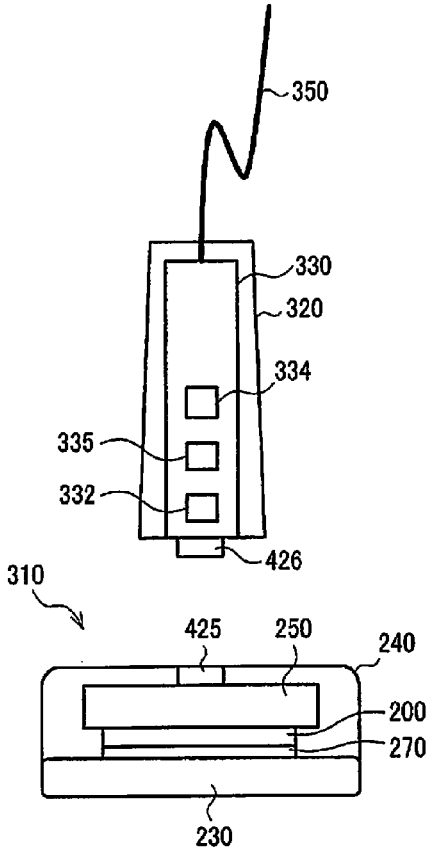

FIG. 17A and FIG. 17B show a configuration example of an ultrasonic probe 300 to which the ultrasonic head unit 220 mentioned above is applied. FIG. 17A shows a case where a probe head 310 is attached to a probe body 320, and FIG. 17B shows a case where the probe head 310 is detached from the probe body 320.

The probe head 310 includes the ultrasonic head unit 220, a contact member 230 that contacts with a material to be tested, and a probe case 240 for housing the ultrasonic head unit 220. The element chip 200 is provided between the contact member 230 and the support member 250.

The probe body 320 includes a processing device 330 and a connector 426 in the probe body 320. The processing device 330 includes a transmission section 332, a reception section 335 (analog front-end section), and a transmission/reception control section 334. The transmission section 332 conducts the transmission of the drive pulse (transmission signal) to the element chip 200. The reception section 335 conducts the reception of the ultrasonic echo signal (reception signal) from the element chip 200. The transmission/reception control section 334 controls the transmission section 332 and the reception section 335. The connector 426 in the probe body is connected to a connector 425 in the ultrasonic head unit (or probe head) side. The probe body 320 is connected to the main body of an electronic device (for example, an ultrasonic image device) through the cable 350.

Although the ultrasonic head unit 220 is housed in the probe case 240, the ultrasonic head unit 220 can be removed from the probe case 240. This makes it possible to replace only the ultrasonic head unit 220. Alternatively, the ultrasonic head unit 220 can be replaced as it is housed in the probe case 240, that is, replaced as the probe head 310.

10. Ultrasonic Image Device

Figure 18:
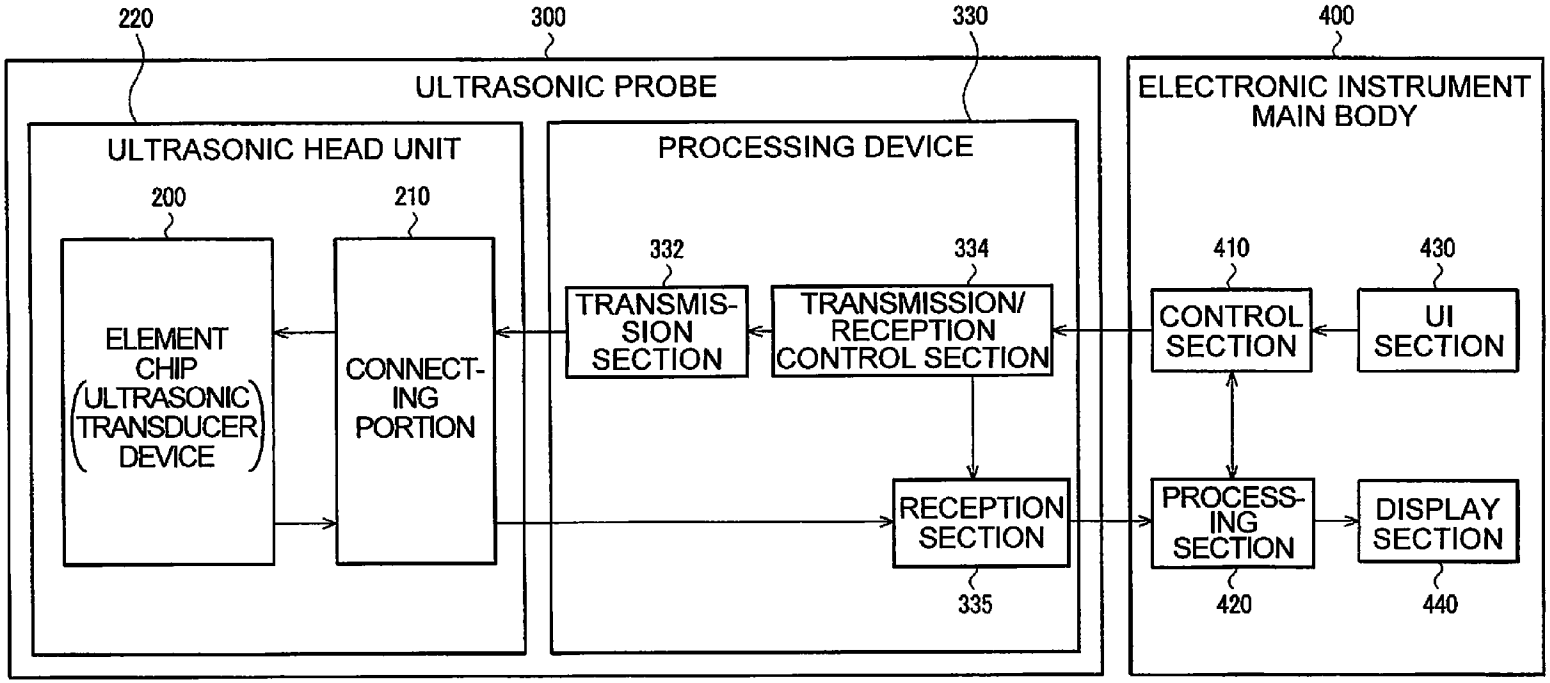
FIG. 18 shows a configuration example of an ultrasonic image device.

FIG. 18 shows a configuration example of an ultrasonic image device. The ultrasonic image device includes the ultrasonic probe 300 and an electronic instrument main body 400. The ultrasonic probe 300 includes the ultrasonic head unit 220 and the processing device 330. The electronic instrument main body 400 includes a control section 410, a processing section 420, a user interface section 430, and a display section 440. FIG. 18 shows an example in which the ultrasonic probe 300 and the electronic instrument main body 400 are separated. However, the present embodiment is not limited to the example, and the ultrasonic probe 300 and the electronic instrument main body 400 may be integrated.

The processing device 330 includes the transmission section 332, the transmission/reception control section 334, and the reception section 335 (analog front-end section). The ultrasonic head unit 220 includes the element chip 200 and the connecting section 210 (connector portion) that connects the element chip 200 to a circuit substrate (rigid substrate, for example). The transmission section 332, the transmission/reception control section 334, and the reception section 335 are mounted on the circuit substrate. The transmission section 332 may include a high voltage generating circuit (boosting circuit, for example) that generates the power supply voltage of the pulser.

In transmitting ultrasonic waves, the transmission/reception control section 334 provides a transmission instruction to the transmission section 332; the transmission section 332 receives the transmission instruction and amplifies a drive signal to the high voltage, thereby outputting a drive voltage. In receiving reflected waves of the ultrasonic waves, the reception section 335 receives the signal of the reflected waves detected by the element chip 200. The reception section 335 processes the signal of the reflected waves (for example, amplification processing, A/D conversion processing, etc.) according to a reception instruction from the transmission/reception control section 334, and transmits the signal after processing to the processing section 420. The processing section 420 images the signal and displays it in the display section 440.

The ultrasonic measurement device according to the present embodiment is not limited to the medical ultrasonic image devices mentioned above, and can be applied to various electronic devices. For example, as an electronic instrument to which the ultrasonic transducer device is applied, a diagnostic instrument that conducts non-destructive inspections to the inside of a building, a user interface instrument that detects movement of a user's finger through reflection of ultrasonic waves, and the like is conceivable.

While the embodiments have been described in detail as above, it will be apparent to those skilled in the art that various modifications can be made herein without substantially departing from the subject matter and the effect of the invention. Therefore, such modifications are included in the scope of the invention. For example, the terms used in the specification or the drawings at least once together with a different term having a broader or similar meaning can be replaced with the different term in any portion of the specification or the drawings. Furthermore, all the combinations of the above embodiments and modifications thereof are also included in the scope of the invention. Furthermore, configurations/operations of the integrated circuit devices, the ultrasonic elements, the ultrasonic transducer devices, the ultrasonic head units, the ultrasonic probes, and the ultrasonic image devices; the mounting methods of the integrated circuit devices; and the scanning methods of the ultrasonic beam; etc. are not limited to those described in the above embodiments, and various modifications can be applied to them.

The entire disclosure of Japanese Patent Application No. 2013-014033, filed Jan. 29, 2013 is expressly incorporated by reference herein.

What is claimed is:

1. An ultrasonic measurement device comprising:

an ultrasonic element array that has at least one reception ultrasonic element column equipped with ultrasonic elements for reception and that has at least one transmission ultrasonic element column equipped with ultrasonic elements for transmission;

a reception terminal connected to the reception ultrasonic element column;

a transmission terminal connected to the transmission ultrasonic element column;

a reception circuit that receives a reception signal from the reception terminal;

a transmission circuit that outputs a transmission signal to the transmission terminal;

a first flexible substrate on which a first integrated circuit device having the reception circuit is mounted; and a second flexible substrate on which a second integrated circuit device having the transmission circuit is mounted, wherein the at least one reception ultrasonic element column and the at least one transmission ultrasonic element column are alternately arranged every column, or any multiple of columns in a first direction, the first direction being a scanning direction, the ultrasonic elements in the reception ultrasonic element column are arranged along a second direction that is orthogonal to the first direction, the ultrasonic elements in the transmission ultrasonic element column are arranged along the second direction, and the reception terminal is arranged at one end of the ultrasonic element array in the second direction, and the transmission terminal is arranged at the other end of the ultrasonic element array in the second direction.

2. An ultrasonic measurement device comprising:

an ultrasonic element array that has at least one reception ultrasonic element column equipped with ultrasonic elements for reception and that has at least one transmission ultrasonic element column equipped with ultrasonic elements for transmission;

a reception terminal connected to the reception ultrasonic element column;

a transmission terminal connected to the transmission ultrasonic element column;

a reception circuit that receives a reception signal from the reception terminal;

a transmission circuit that outputs a transmission signal to the transmission terminal;

a first flexible substrate on which a first integrated circuit device having the reception circuit is mounted; and a second flexible substrate on which a second integrated circuit device having the transmission circuit is mounted, wherein the at least one reception ultrasonic element column and the at least one transmission ultrasonic element column are alternately arranged every column, or any multiple of columns in a first direction, the first direction being a scanning direction, the ultrasonic elements in the reception ultrasonic element column are arranged along a second direction that is orthogonal to the first direction, the ultrasonic elements in the transmission ultrasonic element column are arranged along the second direction, the reception terminal is arranged at one end of the ultrasonic element array in the second direction, and the transmission terminal is arranged at the other end of the ultrasonic element array in the second direction, the reception circuit is one of a plurality of reception circuits included in the first integrated circuit device, the plurality of reception circuits are arranged along the long side direction of the first integrated circuit device in a state in which the first integrated circuit device is mounted on the first flexible substrate, the transmission circuit is one of a plurality of transmission circuits included in the second integrated circuit device, and the plurality of transmission circuits are arranged along the long side direction of the second integrated circuit device in a state in which the second integrated circuit device is mounted on the second flexible substrate.

3. The ultrasonic measurement device according to claim 2, wherein a reception signal line connected to the reception terminal is formed on the first flexible substrate, the first integrated circuit device is mounted on the first flexible substrate so that a long side direction of the first integrated circuit device runs along a direction that crosses a direction of the reception signal line, a transmission signal line connected to the transmission terminal is formed on the second flexible substrate, and the second integrated circuit device is mounted on the second flexible substrate so that a long side direction of the second integrated circuit device runs along a direction that crosses a direction of the transmission signal line.

4. The ultrasonic measurement device according to claim 3, wherein the reception circuit is one of a plurality of reception circuits included in the first integrated circuit device, the plurality of reception circuits are arranged along the long side direction of the first integrated circuit device in a state in which the first integrated circuit device is mounted on the first flexible substrate, the transmission circuit is one of a plurality of transmission circuits included in the second integrated circuit device, and the plurality of transmission circuits are arranged along the long side direction of the second integrated circuit device in a state in which the second integrated circuit device is mounted on the second flexible substrate.

5. The ultrasonic measurement device according to claim 3, wherein the first integrated circuit device is flip-chip mounted on the first flexible substrate, and the second integrated circuit device is flip-chip mounted on the second flexible substrate.

6. The ultrasonic measurement device according to claim 3, further comprising a substrate on which the ultrasonic element array, the reception terminal, and the transmission terminal are arranged, wherein the ultrasonic element array has a plurality of ultrasonic elements as the reception ultrasonic element column and the transmission ultrasonic element column, the substrate has a plurality of openings arranged in an array pattern, each of the plurality of ultrasonic elements has a vibrating film covering a corresponding opening among the plurality of openings and has a piezoelectric element part provided on the vibrating film, and the piezoelectric element part has a lower electrode provided on the vibrating film, a piezoelectric membrane provided so as to cover at least part of the lower electrode, and an upper electrode provided so as to cover at least part of the piezoelectric membrane.

7. An ultrasonic head unit comprising the ultrasonic measurement device according to claim 2, the ultrasonic head unit being detachable from a probe body of an ultrasonic probe.

8. An ultrasonic head unit comprising the ultrasonic measurement device according to claim 3, the ultrasonic head unit being detachable from a probe body of an ultrasonic probe.

9. An ultrasonic probe comprising the ultrasonic measurement device according to claim 1.

10. An ultrasonic probe comprising the ultrasonic measurement device according to claim 3.

11. An ultrasonic image device comprising the ultrasonic measurement device according to claim 2 and a display section that displays display image data.

12. An ultrasonic image device comprising the ultrasonic measurement device according to claim 3 and a display section that displays display image data.

* * * * *